US009846400B2

(12) United States Patent
Ishii et al.

(10) Patent No.: US 9,846,400 B2
(45) Date of Patent: Dec. 19, 2017

(54) IMAGE FORMING APPARATUS THAT EXECUTES LIGHT EMISSION BASED ON DISCHARGE DOT COUNT VALUE

(71) Applicant: Oki Data Corporation, Tokyo (JP)

(72) Inventors: Takeshi Ishii, Tokyo (JP); Shunsuke Sasaki, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/277,762

(22) Filed: Sep. 27, 2016

(65) Prior Publication Data

US 2017/0090376 A1 Mar. 30, 2017

(30) Foreign Application Priority Data

Sep. 30, 2015 (JP) ..... 2015-192495

(51) Int. Cl.
*G03G 15/00* (2006.01)
*G03G 15/08* (2006.01)

(52) U.S. Cl.
CPC ..... *G03G 15/5062* (2013.01); *G03G 15/0822* (2013.01); *G03G 15/0844* (2013.01)

(58) Field of Classification Search
CPC ..... G03G 15/5062; G03G 15/0822; G03G 15/0844
USPC ..... 399/257
See application file for complete search history.

(56) References Cited

U.S. PATENT DOCUMENTS 8,090,278 B2 * 1/2012 Yamane ..... G03G 15/0844 399/257
8,515,301 B2 * 8/2013 Niijima ..... G03G 15/553 399/257
2011/0052219 A1 * 3/2011 Ariizumi ..... G03G 15/5037
2013/0259497 A1 * 10/2013 Yamamoto ..... G03G 15/0887 399/43
2015/0071671 A1 * 3/2015 Kiuchi ..... G03G 15/5062 399/72

FOREIGN PATENT DOCUMENTS

JP 2004-045481 A 2/2004

* cited by examiner

*Primary Examiner* — Sophia S Chen
(74) *Attorney, Agent, or Firm* — Muncy, Geissler, Olds & Lowe, P.C.

(57) ABSTRACT

An image forming apparatus for forming an image on a continuous medium by a print process includes a control part, a process execution part, a control part and a measuring part. The measuring part measures an exposure dot number of each of light emitting elements and a print amount executed by the print process. The process execution part execute a discharge process to discharge developer accommodated in a development part to an outside after completion of a print process based on a most recent print job and before initiation of a print process based on a next print job after the most recent print job, and in the discharge process, the control part makes the exposure part execute light emission based on a discharge dot count value obtained using a measurement result measured by the measuring part during the print process based on the most recent print job.

18 Claims, 12 Drawing Sheets

*Fig. 7*

| | Configuration of Apparatus | Discharging Process | Low Print Rate | Print Distance | Smear Judgment ○:No Smear X: Smear |
|---|---|---|---|---|---|
| Experimental Example #1 | Fig. 1 | Figs. 4A&B | 0.3% | 2 Rolls | ○ |
| Experimental Example #2 | | | | 4 Rolls | ○ |
| Experimental Example #3 | | | 3.0% | 6 Rolls | ○ |
| Experimental Example #4 | | | | 10 Rolls | ○ |
| Experimental Example #5 | | | 5.0% | 6 Rolls | ○ |
| Comparative Example #6 | Fig. 1 | Off | 0.3% | 2 Rolls | ○ |
| Comparative Example #7 | | | | 4 Rolls | × |
| Comparative Example #8 | | | 3.0% | 6 Rolls | ○ |
| Comparative Example #9 | | | | 10 Rolls | × |
| Comparative Example #10 | Fig. 5 | Fig. 6 | 0.3% | 8000 Sheets (1208m) | × |
| Comparative Example #11 | Fig. 1 | | | 4 Rolls (1200m) | × |

IMAGE FORMING APPARATUS THAT EXECUTES LIGHT EMISSION BASED ON DISCHARGE DOT COUNT VALUE

CROSS REFERENCE TO RELATED APPLICATION(S)

This application claims priority under 35 USC 119 to Japanese Patent Application No. 2015-192495 filed on Sep. 30, 2015, the entire contents which are incorporated herein by reference.

TECHNOLOGY FIELD

The present invention relates to an image forming apparatus for printing an image on a continuous medium.

BACKGROUND

In a print process of an image forming apparatus employing an electrographic system, a method for executing a discharging (waste) process of a toner (deteriorated toner) in a development device by comparing the printing rate in a period until the number of rotations of a photosensitive drum as a image carrier reaches a predetermined number of rotations (corresponds to the number of print dots) and a threshold value is proposed (for example, see Patent Document 1).

RELATED ART

[Patent Doc.] Japanese Laid-Open Application Publication 2004-45481 (for example, paragraphs 0033 to 0043, FIG. 4)

However, in the conventional method, the discharge process of the toner inside the development device may sometimes not be executed even when the number of rotations of the photosensitive drum in the print process reaches the predetermined number of rotations. In such a case, the quality of images to be formed in the next print process may sometimes be deteriorated from the effect of the deteriorated toner increased inside the development device.

The present invention was made to solve the problems in the abovementioned conventional technology and aims to provide an image forming apparatus capable of improving the quality of images to be printed on a continuous medium.

SUMMARY

An image forming apparatus disclosed in the application for forming an image on a continuous medium by a print process based on a print job includes a process execution part that executes the print process; a control part that controls an operation of the process execution part based on the print job; and a measuring part. Wherein, the process execution part includes an image carrier on which an electrostatic latent image is formed, an exposure part that is composed with a plurality of light emitting elements, the exposure part forming the electrostatic latent image on the image carrier by emitting light on the image carrier while light emission of each of the light emitting elements is controlled by the control part, and a development part that accommodates a developer and forms a developer image on the image carrier by supplying the developer to the image carrier, the measuring part measures an exposure dot number of each of the light emitting elements and a print amount executed by the print process. Wherein the control part makes the process execution part execute a discharge process to discharge the developer accommodated in the development part to an outside of the development part after completion of a print process based on a most recent print job and before initiation of a print process based on a next print job after the most recent print job, and in the discharge process, the control part makes the exposure part execute light emission based on a discharge dot count value obtained using a measurement result measured by the measuring part during the print process based on the most recent print job.

According to the present invention, the quality of images to be printed on a continuous medium can be improved.

BRIEF DESCRIPTION OF THE DRAWINGS

FIG. 7 shows the a configuration, a discharge process, a printing rate (print duty), a print distance, and the result of smear judgment for the image forming apparatus according to Embodiment 1 (Experimental Examples #1 to #5) and the image forming apparatus of the Comparative Examples (Experimental Examples #6 to #11) in a table format.

DETAILED DESCRIPTION OF THE EMBODIMENT(S)

<<1>> Embodiment 1

<<1-1>> Configuration of the Image Forming Apparatus

Figure 1:
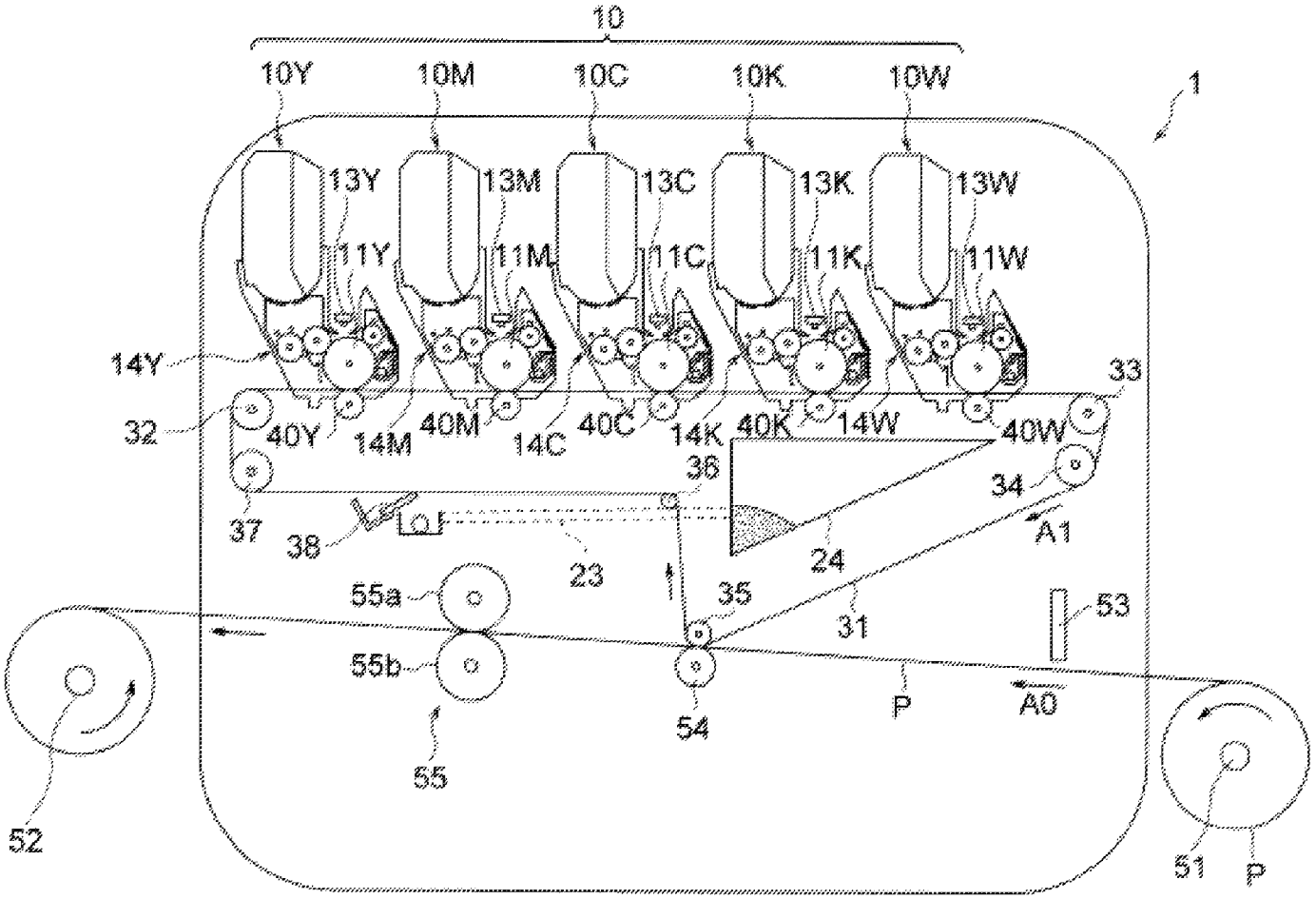
FIG. 1 is a vertical cross-sectional view schematically showing a configuration of an image forming apparatus according to a first embodiment of the present invention.

FIG. 1 is a vertical cross-sectional view schematically showing a configuration of the image forming apparatus 1 according to a first embodiment of the present invention. The image forming apparatus 1 is a printer configured to form images (for example, toner images as developer images) on a continuous medium (recording medium) by a print process (print operation) based on a print job using a toner as a developer by an electrographic system. Specifically, the image forming apparatus 1 shown in FIG. 1 is a color printer configured to perform color printing. However, the present invention can also be applied to monochromatic printers. Further, the present invention can also be applied to copiers, fax machines, and multifunction machines.

In this application, a "print job" is a print command (a command for executing a print process) to be sent to the image forming apparatus 1 (specifically, a later-described image data converter 67) from an external device. "One print job" is a command particularly for making the image forming apparatus 1 execute one set of print process. One print job is, for example, a print process for printing a one-page manuscript image once on a recording medium, a print process for printing a one-page manuscript image three times on a recording medium, a print process for printing a three-page manuscript image once on a recording medium, or a print process for printing a three-page manuscript image four times on a recording medium.

The image forming apparatus 1 is equipped with process execution parts 10Y, 10M, 10C, 10K, and 10W as image forming parts conured to execute the print processes. Specifically, the process execution parts 10Y, 10M, 10C, 10K, and 10W form yellow (Y), magenta (M), cyan (C),black (K), and white (W) images, respectively. The process execution parts 10Y, 10M, 10C, 10K, and 10W are arranged in one array tandem arrangement) in that order. The process execution parts 10Y, 10M, 10C, 10K, and 10W have the same configuration except that the type (color) of the toners to be used is different. Therefore, each of the process execution parts 10Y, 10M, 10C, 10K, and 10W is also referred to as a process execution part 10. Further, the number of the process execution parts equipped in the image forming apparatus 1 can be a number besides five. Furthermore, the colors of the toner of the process execution parts equipped in the image forming apparatus 1 are not limited to yellow (Y), magenta (M), cyan (C), black (K), and white (W).

The image forming apparatus 1 is equipped with a rolled sheet feeder 51 (rolled sheet holder) as a rolled sheet supply part held rotatably and configured to supply a rolled sheet P on the supply side, which is a recording medium before images are printed, and a rewinder 52 as a rolled sheet winding part for winding the rolled sheet P (rolled sheet P on the winding side after the images are printed) supplied by the rolled sheet feeder 51. The image forming apparatus 1 may be equipped with a cutter 53 as a cutting part for cutting the rolled sheet P that is pulled out in the arrow AO direction from the rolled sheet feeder 51 after the completion of printing of one page.

An embodiment in which both ends of the rolled sheet P are fixed to the rolled sheet supporting shaft of the rolled sheet feeder 51 and the rolled sheet winding shaft of the rewinder 52 to carry out the printing on the rolled sheet P is called "roll to roll printing" (roll-to-roll printing).

In Embodiment 1, a case in which the width of the rolled sheet Pin the main scanning direction is 105 [mm] and the length of one roll of rolled sheet Pin the sub-scanning direction (that is, the length of one roll of the rolled sheet P) is 300 [m] will be described. However, the width and the length of the rolled sheet P are not limited to the aforementioned example.

The image forming apparatus 1 is equipped with an endless intermediate transfer belt 31 below the process execution parts 10Y, 10M, 10C, 10K, and 10W. The intermediate transfer belt 31 is movably supported by supporting rollers 32, 33, 34, 35, 36, and 37. The supporting roller 33 is a drive roller for carrying the intermediate transfer belt 31 in the arrow A1 direction. The supporting roller 35 is also called a backup roller. The supporting roller 36 is also called a tension roller.

Further, the image forming apparatus 1 is equipped with primary transfer rollers 40Y, 40M, 40C, 40K, and 40W as transfer parts (primary transfer parts) for transferring the toner images to the intermediate transfer belt 31 from the process execution parts 10Y, 10M, 10C, 10K, and 10W to the opposite side of the process execution parts 10Y, 10M, 10C, 10K, and 10W sandwiching the intermediate transfer belt 31. The toner image formed by the process execution parts 10Y, 10M, 10C, 10K, and 10W are transferred (primary transferred) on the intermediate transfer belt 31 by the primary transfer rollers 40Y, 40M, 40C, 40K, and 40W. Further, each the primary transfer rollers 40Y, 40M, 40C, 40K, and 40W is also referred to as a primary transfer roller 40.

The image forming apparatus 1 is equipped with a secondary transfer roller 54 as a transfer part (secondary transfer part) arranged sandwiching the intermediate transfer belt 31 below the supporting roller 35 (backup roller) arranged on the inner side of the intermediate transfer belt 31. The secondary transfer roller 54 transfers the toner image formed on the intermediate transfer belt 31 on the rolled sheet P.

The image forming apparatus 1 is equipped with a belt cleaning member 38 for scraping the toner remaining on the intermediate transfer belt 31 from the intermediate transfer belt 31 after the transfer by the secondary transfer roller 54, a waste toner collection part 24 for accommodating the toner (waste toner) scraped by the belt cleaning member 38, and a toner carrying part 23 for carrying the waste toner to the waste toner collection part 24 from the belt cleaning member 38. The toner carrying part 23 is equipped with, for example, a carrying path for carrying the waste toner, a spiral member for sending the waste toner, and a spiral drive part for rotating the spiral member.

The image forming apparatus 1 is equipped with a fuser part 55 for fusing the toner image transferred on the rolled sheet P by applying heat and pressure. The fuser part 55 is equipped with a heat application roller 55*a* and a pressure application roller 55*b*.

Figure 2:
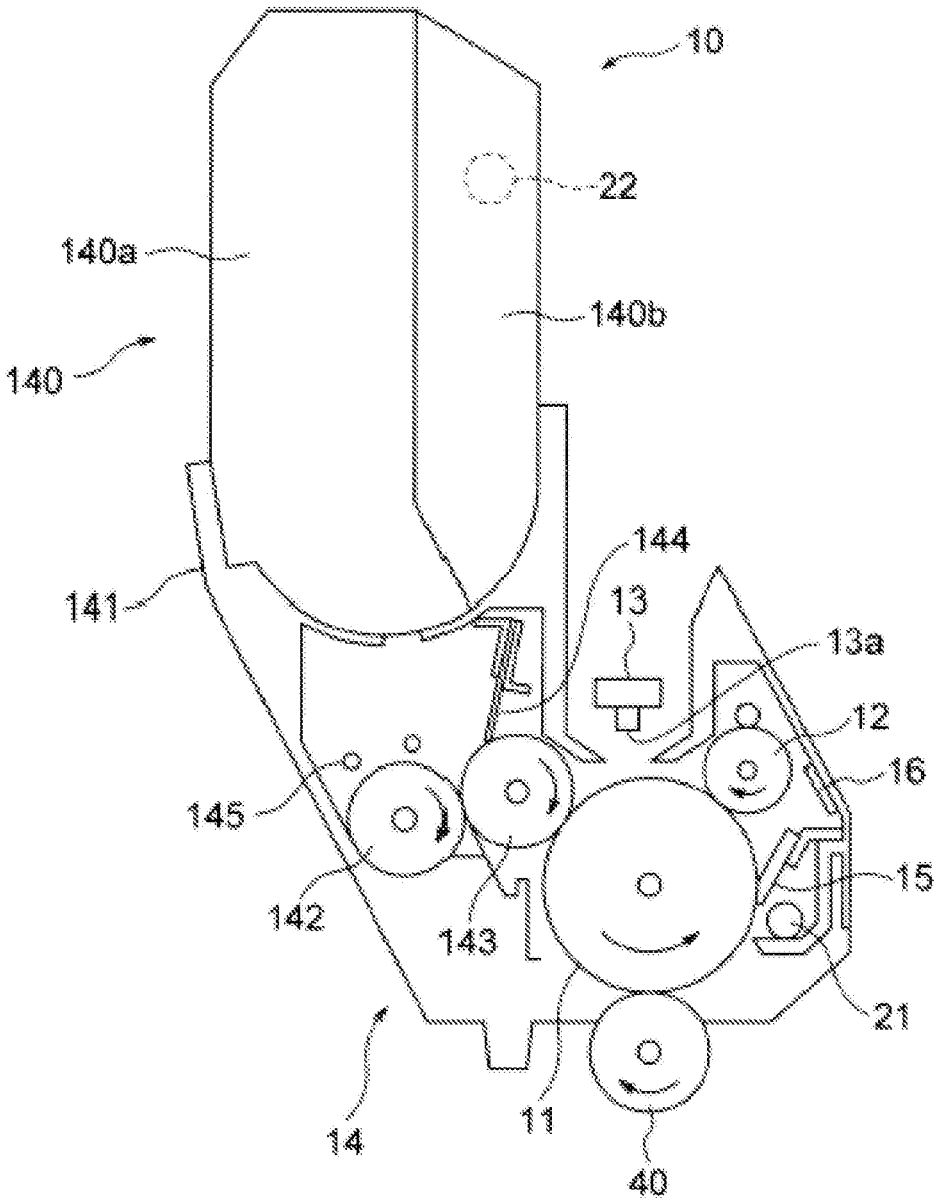
FIG. 2 is a vertical cross-sectional view schematically showing a configuration of a process execution part (image forming part) shown in FIG. 1.

FIG. 2 is a vertical cross-sectional view schematically showing a configuration of the process execution part 10. The process execution part 10 is equipped with cylindrical photosensitive drums 11 (11Y, 11M, 11C, 11K, and 11W) as image carriers to which electrostatic latent images are formed on the surface thereof The photosensitive drums 11 are, for example, equipped with a cylindrical conductive support and a photoreceptive layer equipped on the surface of the conductive support. The photosensitive drum 11 rotates in one direction (counterclockwise in FIG. 2) by a driving force produced at a driving force generation part such as a photosensitive drum motor 11*a* (see later-described FIG. 3) and transmitted by a driving force transmission part such as a gear, etc.

The process execution part 10 is equipped with a photosensitive drum 11, a charge roller 12 as a charging part, an optical head 13 (13Y, 13M, 13C, 13K, 13W) as an exposure part, and a development part 14 (14Y, 14M, 14C, 14K, and 14W).

The process execution part 10 is equipped with a cartridge 140 configured to accommodate an unused toner (also referred to as "toner") and a waste toner. Specifically, the cartridge 140 is equipped with an unused toner accommodation part 140*a* for accommodating an unused toner (first toner accommodation part) and a waste toner accommodation part 140*b* for accommodating a waste toner (second toner accommodation part).

The charge roller 12 is equipped with, for example, a metal shaft and a semiconductive elastic layer formed on the surface of the shaft. A predetermined bias voltage is applied to the charge roller 12 from a charge roller power source 72. The charge roller 12 is driven to rotate in accordance with the rotation of the photosensitive drum 11 to uniformly charge the surface of the photosensitive drum 11.

The optical head 13 is equipped with a light emitting element array having a plurality of light emitting elements 13*a* arranged in the main scanning direction (in a direction of the rotation axis of the photosensitive drum 11) and a rod lens array. For example, each of the light emitting element 13*a* is a light emitting diode (LED: Light Emitting Diode), and the light emitting element array is an LED array. The optical head 13 emits light (dot shaped light) on the photosensitive drum 11 to form an electrostatic latent image on the photosensitive drum 11. Specifically, the optical head 13 forms an electrostatic latent image on the photosensitive drum 11 by forming an image with the light of the light emitting elements 13*a* emitted according to the image data on a uniformly charged photosensitive drum 11 with a rod lens array. In the present application, a case in which the LED array pitch of the LED array is 1200 dpi (dots per inch) will be described. Further, in this application, a case will be described, in which the light emission amount of the plurality of light emitting elements 13*a* is constant and either a lighting state in which the light emitting element 13*a* is emitting light or a non-lighting state in which it is not emitting light is selected. However, the optical head 13 as an exposure part can be any parts employing any methods such as a laser scanning part.

The development part 14 is equipped with a casing 141, a supply roller 142 as a developer supply member, a development roller 143 as a developer carrier, a development blade 144 as a developer regulatory member and an agitating member 145.

The casing 141 accommodates the supply roller 142, the development roller 143, the development blade 144, and the agitating member 145. Further, the casing 141 accommodates an unused toner, which is a developer supplied from the unused toner accommodation part 140*a*.

The development roller 143 is equipped with, for example, a metal shaft and a semiconductive elastic layer formed on the surface of the shaft. In this embodiment, a urethane rubber having an ASKER C hardness of 78 degrees is used as a semiconductive elastic layer and a conducting agent in which carbon black is mixed is used. It is preferable that the surface layer covering the surface of the elastic layer is selected in consideration of, e.g., wear resistance and application of electric charge to the toner. In this embodiment, a case in which a urethane resin is used as a surface layer is described. The surface roughness and the resistance value of the development roller 143 needs to be set so that the toner layer thickness and the toner amount on the development roller 143 is a desired amount. In this embodiment, it is preferable that the ten-point average surface roughness measurement Rz is within a range of 2 [μm] to 8 [μm], and the measurement of the resistance value including the elastic layer and the surface layer is set within a range of $1\times10^6$[Ω] to $1\times10^8$[Ω].

A predetermined bias voltage is applied to the development roller 143 from the development roller power source 73 (see later-described FIG. 3). The development roller 143 rotates in the same direction as the photosensitive drum 11 at the contact part with the photosensitive drum 11 (direction opposite to the rotation direction of the development roller 143 and rotation direction of the photosensitive drum 11) and forms a toner image on the photosensitive drum 11 by supplying the toner to the surface of the photosensitive drum 11.

A supply roller 142 as a developer supply part and a development blade 144 as a developer regulatory member are arranged adjacent to the development roller 143. In the supply roller 142, for example, a foamed silicon rubber layer is formed on the metal shaft. A predetermined bias voltage is applied to the supply roller 142 from the supply roller power source (74 of the later-described FIG. 3), and the supply roller 142 rotates in the opposite direction of the development roller 143 at the contact part with the development roller 143 and supplies a toner to the surface of the development roller 143. The overlap amount of the supply roller 142 and the development roller 143 at the nip part is, for example, 1.0 [mm].

The development blade 144 is formed by, for example, bending a plate-shaped member elongated in the axial direction of the development roller 143 and stainless steel is used as the material. The thickness of the plate is, for example, 0.08 [mm]. The curved surface of the bent part of the development blade 144 is pressed against the surface of the development roller 143, and the thickness of the toner layer is regulated by the pressing force to form a toner thin layer on the development roller 143. A predetermined bias voltage is applied to the development blade 144 from the supply roller power source 74 (see later-described FIG. 3).

The photosensitive drum 11 of the process execution part 10 integrated in the image forming apparatus 1 is in contact with the intermediate transfer belt 31, and a primary transfer roller 40 is provided on the opposite side of the photosensitive drum 11 sandwiching the intermediate transfer belt 31. A predetermined bias voltage is applied to the primary transfer roller 40 from the transfer roller power source 71 (see later-described FIG. 3), and the primary transfer roller 40 transfers the toner image formed on the surface of the photosensitive drum 11 to the intermediate transfer belt 31.

The process execution part 10 is equipped with a cleaning member 15 provided on the downstream side in the rotation direction of the photosensitive drum 11, a carrying spiral 21 configured to carry the toner (waste toner) scraped by the cleaning member 15, and a carrying path 22 on which the waste toner is carried. The cleaning member 15 is, for example, a blade made of polyurethane rubber in contact with the photosensitive drum 11, and removes the toner remaining on the surface of the photosensitive drum 11 after the execution of the primary transfer. The carrying path 22 is connected to the waste toner accommodation part 140*b*. The carrying spiral 21 can carry the toner (waste toner) scraped with the cleaning member 15 to the waste toner accommodation part 140*b*.

The process execution part 10 is equipped with a discharging light irradiation part 16 provided more on the downstream side in the rotation direction than the cleaning member 15 of the photosensitive drum 11. The discharging light irradiation part 16 is arranged so as not to be in contact with the photosensitive drum 11 and removes the residual electric charge on the surface of the photosensitive drum 11. The discharging light irradiation part 16 is, for example, constituted with an LED.

Hereinafter, the toner used for the Experimental Examples #1 to #11 will be described. The toner used is a nonmagnetic one-component negatively chargeable toner. The toner is constituted by mother particles in which a coloring agent, a binder resin, and a wax are agglomerated, and an external additive added to the mother particles. The mother particle of the toner is produced using a pulverization method and uses, for example, pigment yellow (Y), quinacridone (M), copper phthalocyanine (C), carbon black (K), titanium oxide (W), etc. For the binder resin, polyester is used, for example, with the purpose of improving the dispersiveness of the pigments. The wax is used for the purpose of, e.g., preventing the toner from adhering to the heat application roller 55*a* at the time of fusing.

The external additive is added to the mother particles of the toner for the purpose of controlling the flowability and the chargeability of the toner, and for example, titanium oxide, alumina, silica, melamine, etc., are used. Furthermore, for silica, silica subjected to a surface reforming such as silicone oil processing and disilazane processing to improve the hydrophobicity and the flowability may be used. The volume mean particle diameter of the toners of each color is, for example, 5.6 [μm] for yellow (Y), magenta (M), cyan (C), and black (K), and 7.0 [μm] for white (W). The volume mean particle diameter can be measured using a grain size distribution measurement device (Coulter Multisizer II manufactured by Coulter, Inc.) The circularity degree of the toner of each color is, for example, 0.97. The circularity degree is measured using a flow-type particle image analysis device (FPIA-3000 manufactured by Sysmex Corp.) and the following formula is used for the calculation of the circularity degree. Circularity degree=(circumference length of the circle having the same area as the particle image projection image)/(circumference length of the particle image projection image). From this formula, a value between 0 and 1 showing the circularity degree is calculated. The value of the circularity degree in the case of a perfect sphere shape is 1, and the value of the circularity degree is smaller as the shape becomes complex.

The blow-off charge amount of the toner in each color is, for example, −36 [μC/g]. The blow-off charge amount can be obtained by using a power charge amount measurement device (TYPE TB-203 manufactured by Kyocera Corp.) to mix 0.5 [g] of the toner and 9.5 [g] of a ferrite carrier (F-60 manufactured by Powder Tech Co., Ltd.) and by measuring the saturated charge amount under the condition of flow pressure of 7.0 [kPa] and suction pressure of −4.5 [kPa] after agitating for 30 minutes.

Figure 3:
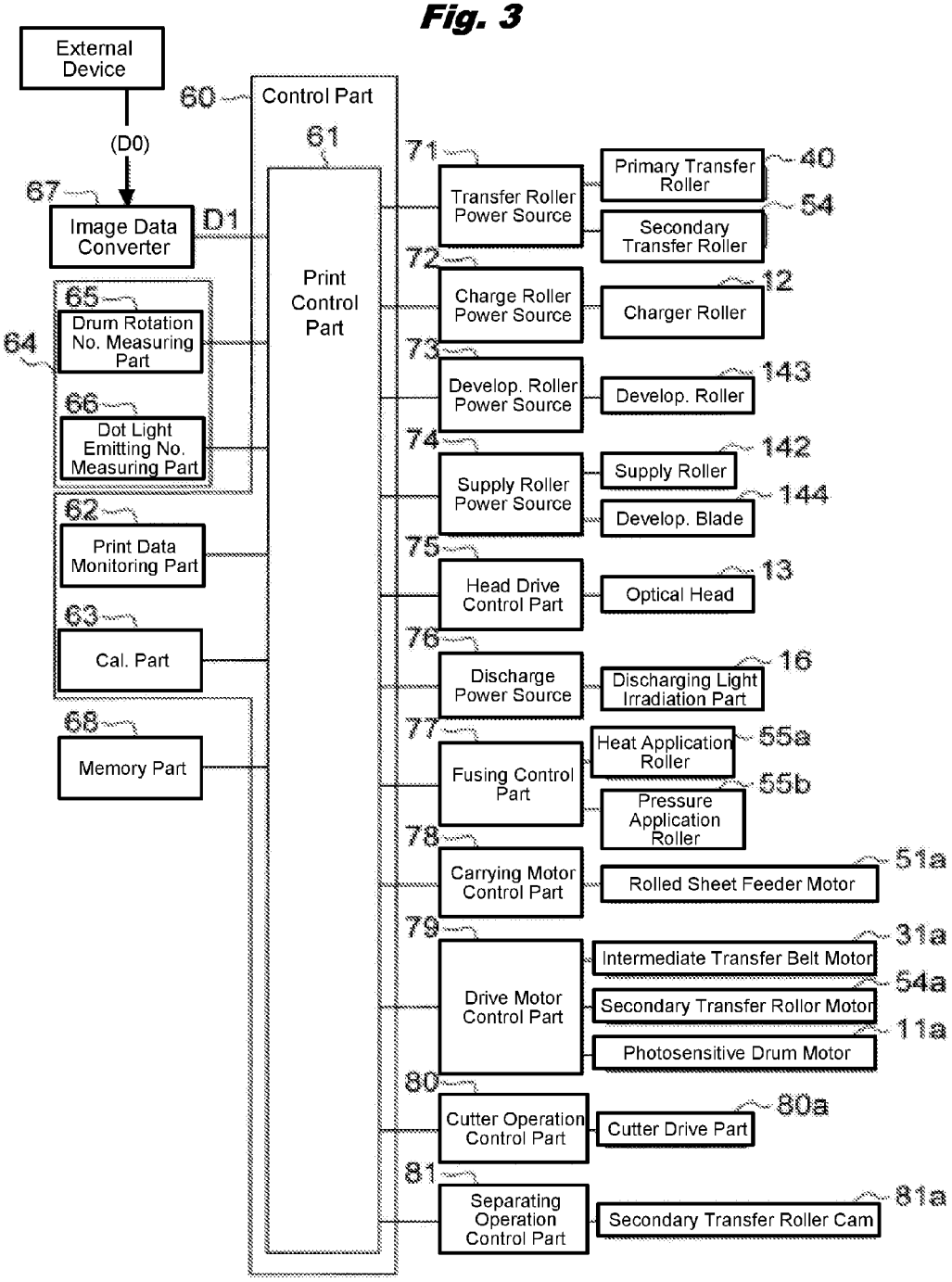
FIG. 3 is a block diagram schematically showing a configuration of a control system of the image forming apparatus according to Embodiment 1 of the present invention.

FIG. 3 is a block diagram schematically showing a configuration of the control system of the image forming apparatus 1 according to a first embodiment. The image forming apparatus 1 is equipped with a control part 60 as a main control part and a measuring part 64.

The control part 60 is equipped with a print control part 61 managing various controls, a print data monitoring part 62 for monitoring the changing of the page in the print data, and a calculation part 63 for performing various calculations. For example, the control part 60 (specifically the print control part 61) controls the operation of the process execution part 10 based on the print job. For example, the control part 60 (specifically, the print control part 61) controls the light emission of each light emitting element 13*a* of the optical head 13 via the head drive control part 75.

The measuring part 64 is equipped with a drum rotation number measuring part 65 for measuring the rotation number of the photosensitive drum 11 and a dot light emitting number measuring part 66 for measuring the light emitting number of the light emitting element 13*a* corresponding to the image data of the optical head 13. For example, the measuring part 64 (specifically the dot light emitting number measuring part 66) measures exposure dot number of the light emitting elements 13*a*.

The image forming apparatus 1 is equipped with an image data converter 67 for receiving a print job (image data) D0 from an external device, for example, a personal computer (PC) and generating a control signal (head light emission command data D1 for the optical head 13) based on the print job D0, and a memory part 68 for storing the results of the calculations of the control part 60, etc.

The image forming apparatus 1 is further equipped with a transfer roller power source 71 configured to apply a predetermined voltage to the primary transfer roller 40 and the secondary transfer roller 54, a charge roller power source 72 configured to apply a predetermined voltage to the charge roller 12, a development roller power source 73 configured to apply a predetermined voltage to the development roller 143, a supply roller power source 74 configured to apply a predetermined voltage to the supply roller 142 and the development blade 144, a head drive control part 75 as a drive part to make the optical head 13 emit light, and a discharge power source 76 configured to apply voltage to make the discharging light irradiation part 16 emit light.

The image forming apparatus 1 is further equipped with a fusing control part 77 configured to control the operation of the heat application roller 55*a* and the pressure application roller 55*b*, a carrying motor control part 78 configured to control the rolled sheet feeder motor 51*a*, a drive motor control part 79 configured to control the rotation drive of the intermediate transfer belt motor 31*a*, the secondary transfer roller motor 54*a*, and the photosensitive drum motor 11*a*, a cutter operation control part 80 configured to control the cutter drive part 80*a* which operates the cutter 53, and a separating operation control part 81 configured to control the secondary transfer roller cam 81*a* for contacting and separating the intermediate transfer belt 31 to and from the secondary transfer roller 54.

The print control part 61, the print data monitoring part 62, and the calculation part 63 constitute the control part 60. The drum rotation number measuring part 65 and the dot light emitting number measuring part 66 constitute the measuring part 64.

<<1-2>> Print Operation

Next, the print operation of the image forming apparatus 1 will be described with reference to FIG. 1, FIG. 2, and FIG. 3.

In the image forming apparatus 1, the print job D0 is sent from a host device such as a personal computer (PC) and a scanner and received by the image data converter 67. The image data converter 67 converts the image data included in the received print job D0 to head light emission command data D1.

The print control part 61 starts the print operation when the head light emission command data D1 based on the print job D0 is received from the image data converter 67. The print control part 61 drives the photosensitive drum motor 11*a* as a driving force generation part via the drive motor control part 79 and rotates the photosensitive drum 11 at a constant peripheral velocity in the arrow direction of FIG. 2. The driving force by the rotation of the photosensitive drum 11 is transmitted to a gear array as a driving force transmission part, etc., and rotates the development roller 143 and the supply roller 142 in the arrow direction of FIG. 2. The charge roller 12 rotates in the arrow direction of FIG. 2 together with the photosensitive drum 11. At this time, a direct current voltage is applied to the charge roller 12 provided so as to be in contact with or pressed against the surface of the photosensitive drum 11 from the charge roller power source 72, so that the surface of the photosensitive drum 11 is uniformly (evenly) charged. In this embodiment, the aluminum raw tube of the photosensitive drum 11 is grounded, and the surface of the photosensitive drum 11 is charged to around −500 [V] by applying a direct current voltage of −1000 [V] to the charge roller 12.

Next, in the exposure process, dot-shaped lights corresponding to the head light emission command data D1 is irradiated from a plurality of LEDs of the optical heads 13 onto the surface of the charged photosensitive drum 11, so that an electrostatic latent image is formed on the photosensitive drum 11. In this embodiment, the electrical potential of the photosensitive drum 11 at the exposed portion is around −50 [V]. Further, the irradiation by the optical head 13 is also executed during the generation of the head light emission command data D1 of one print job and not after all of the head light emission command data D1 of one print job are generated.

Furthermore, an electrostatic latent image on the photosensitive drum 11 is developed by the toner and a toner image is formed on the photosensitive drum 11 from the operation of the development part 14. In this embodiment, a direct current voltage of −200 [V] is applied to the development roller 143 from the development roller power source 73. Further, the electrical potential of the toner layer on the development roller 143 made into a thin layer is around −50 [V]. Since the total of the electrical potential of the toner thin layer and the voltage applied to the development roller 143 exceeds the electrical potential of the exposure part on the photosensitive drum 11, the exposure part on the photosensitive drum 11 is developed by the toner. Since the total of the electrical potential of the toner thin layer and the voltage applied to the development roller 143 does not exceed the electrical potential of the unexposed part on the photosensitive drum 11, the unexposed part on the photosensitive drum 11 is not developed by the toner.

Further, the drive motor control part 79 controls the intermediate transfer belt motor 31*a*, so that the intermediate transfer belt 31 rotates in the arrow A1 direction of FIG. 1. A direct current voltage +2000 [V] is applied to the primary transfer roller 40 provided so as to face the photosensitive drum 11 from the transfer roller power source 71. The toner image formed on the photosensitive drum 11 is primary transferred onto the intermediate transfer belt 31 from the electric field generated between the primary transfer roller 40 (+2000 [V]) and the raw tube of the photosensitive drum 11 (grounded electrical potential). From the rotation of the intermediate transfer belt 31, toner images in a maximum of five colors, Y, M, C, K, and W, are laminated on the intermediate transfer belt 31 after passing the white process execution part 10W.

On the other hand, the rolled sheet P is sent to the secondary transfer part, that is, between the intermediate transfer belt 31 and the secondary transfer roller 43 by the drive of the rolled sheet feeder motor 5 la connected to the carrying motor control part 78. At this time, the secondary transfer roller 54 is in contact with the intermediate transfer belt 31 by the separation operation control part 81. Further, the supporting roller 35 is grounded. A direct current voltage of +2000 [V] is applied to the secondary transfer roller 54 provided so as to face the supporting roller 35 from the transfer roller power source 71. The toner image formed on the intermediate transfer belt 31 is transferred on the rolled sheet P by the electric field generated between the secondary transfer roller 54 (+2000 [V]) and the supporting roller 35 (grounded).

After passing the secondary transfer part, the rolled sheet P further passes between the heat application roller 55*a* and the pressure application roller 55*b* constituting the fuser part 55. And from the heat and the pressure, the toner on the rolled sheet P melts and permeates between the fibers of the rolled sheet to perform the fuser of the toner image on the rolled sheet P. The rolled sheet P in which the toner image is fused is winded by the rewinder 52.

The print data monitoring part 62 recognizes a change of page by detecting that the light emission of the optical head 13 by the head light emission command data D1 converted in the image data converter 67, and after that, the cutter 53 is operated by the cutter operation control part 80 and the rolled sheet is cut at a position behind by a margin than the position on the rolled sheet P in which the printing was completed.

Further, a slight amount of toner sometimes remains on the photosensitive drum 11 after the primary transfer, but the remaining toner is removed by the cleaning member 15. Further, the unexposed electric charge on the photosensitive drum 11 is removed by light irradiating the photosensitive drum 11 by the discharging light irradiation part 16. The surface of the photosensitive drum 11 in which the electric charge was removed is charged again by the charge roller 12. In this way, the photosensitive drum 11 is repeatedly used for image forming.

Further, a slight amount of toner sometimes remains on the intermediate transfer belt 31 after the secondary transfer, but the remaining toner is removed by the belt cleaning member 38. The toner removed by the belt cleaning member 38 is carried by a waste toner carrying member, for example, a toner carrying part 23 such as a spiral for carrying toners (rotating spiral shape blade part), a toner carrying paddle, etc., and collected by the waste toner collection part 24. In this way, the intermediate transfer belt 31 is repeatedly used for image forming.

Next, the operation of the development part 14 in the print step will be described. The development roller 143 and the supply roller 142 receive the rotation driving force of the photosensitive drum 11 and rotate in the arrow direction of FIG. 2. The toner accommodated in the unused toner accommodation part 140*a* is sent to the development roller 143 by the rotation of the supply roller 142. Since the supply roller 142 and the development roller 143 rotate in the opposite direction at the contact part thereof, the toner is negatively charged by the friction. When the toner sent to the development roller 143 passes the contact part with the development blade 144 by the rotation of the development roller 143, the toner is made into a thin layer while being frictionally charged by the development roller 143 and the development blade 144. In this embodiment, a direct current voltage of −300 [V] is applied to the supply roller 142 and the development blade 144 from the supply roller power source 74. After that, the toner on the development roller 143 made into a thin layer is developed corresponding to the electrostatic latent image formed on the photosensitive drum 11 and furthermore, the electrostatic latent image becomes a toner image.

The toner is rubbed at the contact part of the development roller 143 and the supply roller 142 and the contact part of the development roller 143 and the development blade 144. When the print operation in a state in which the optical head 13 is unexposed continues, the toner continuously moves around the development roller 143 without being used, repeating the rubbing with the supply roller 142 and the development blade 144, gradually causing deterioration of the toner to due to peeling of the external additives. In the deteriorated toner, the flowability and the chageability are decreased different from the beginning and since it is in a state in which electric charge is easily retained in the toner due to agglomeration of the toners, staining can easily occur. Further, the deteriorated toner is easily retained around the development roller 143. Specifically, when the electrical potential of the toner layer when the metal shaft on the development roller 143 is grounded becomes −100 [V] or below (for example, when the development voltage is not applied), white contamination occurs.

<<1-3>> Toner Discharging (Disposing) Operation

Figure 4A:
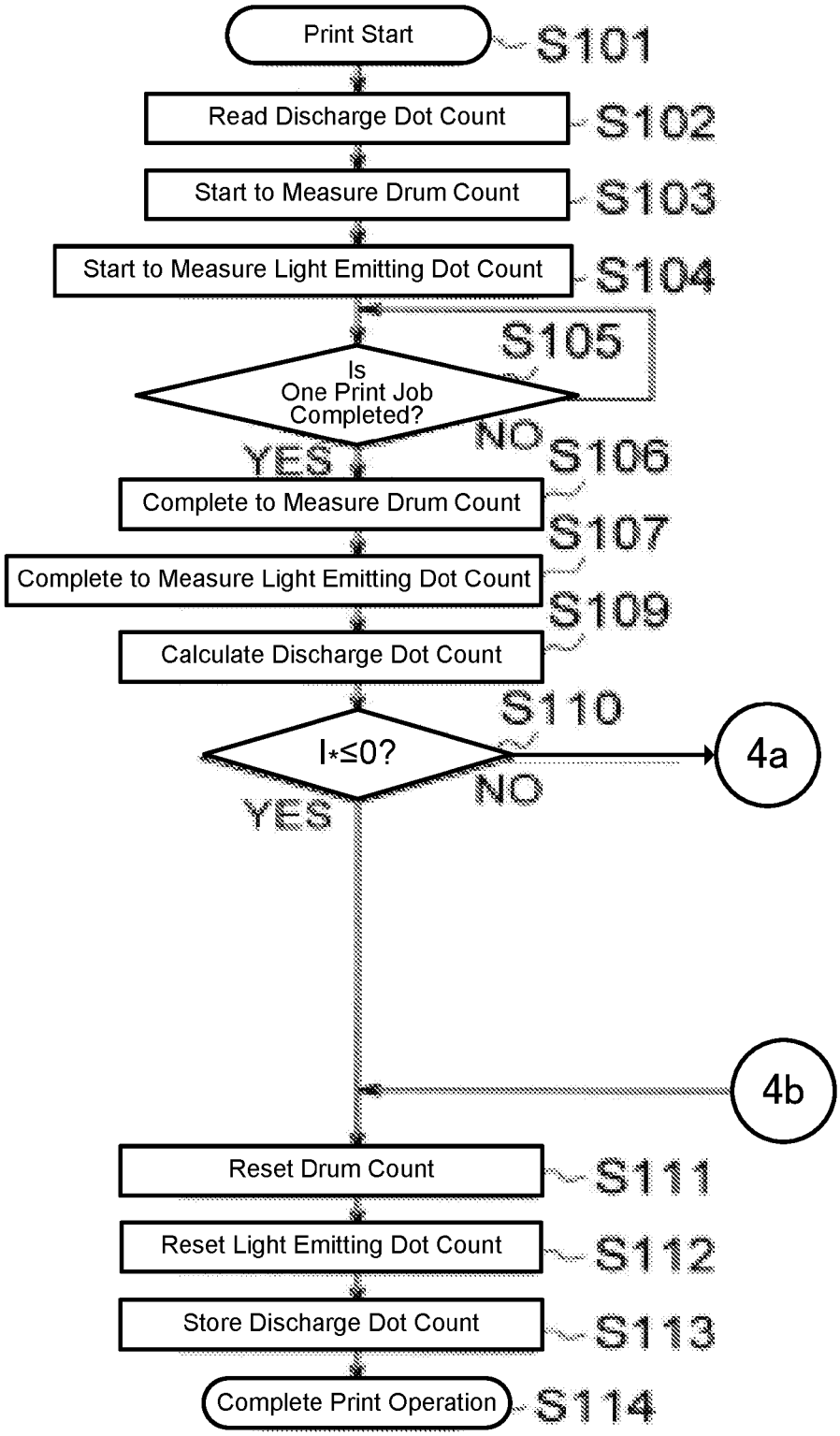
FIGS. 4A and 4B are flowcharts showing an operation of the image forming apparatus according to Embodiment 1 of the present invention. Between the two flowcharts, "4*a*" and "4*b*" in FIG. 4A respectively connect to "4*a*" and "4*b*" in FIG. 4B so that a step following S110 in FIG. 4A is S115 in FIG. 4B. In the same manner, step following S119 in FIG. 4B is S111 in FIG. 4A.
Figure 4B:
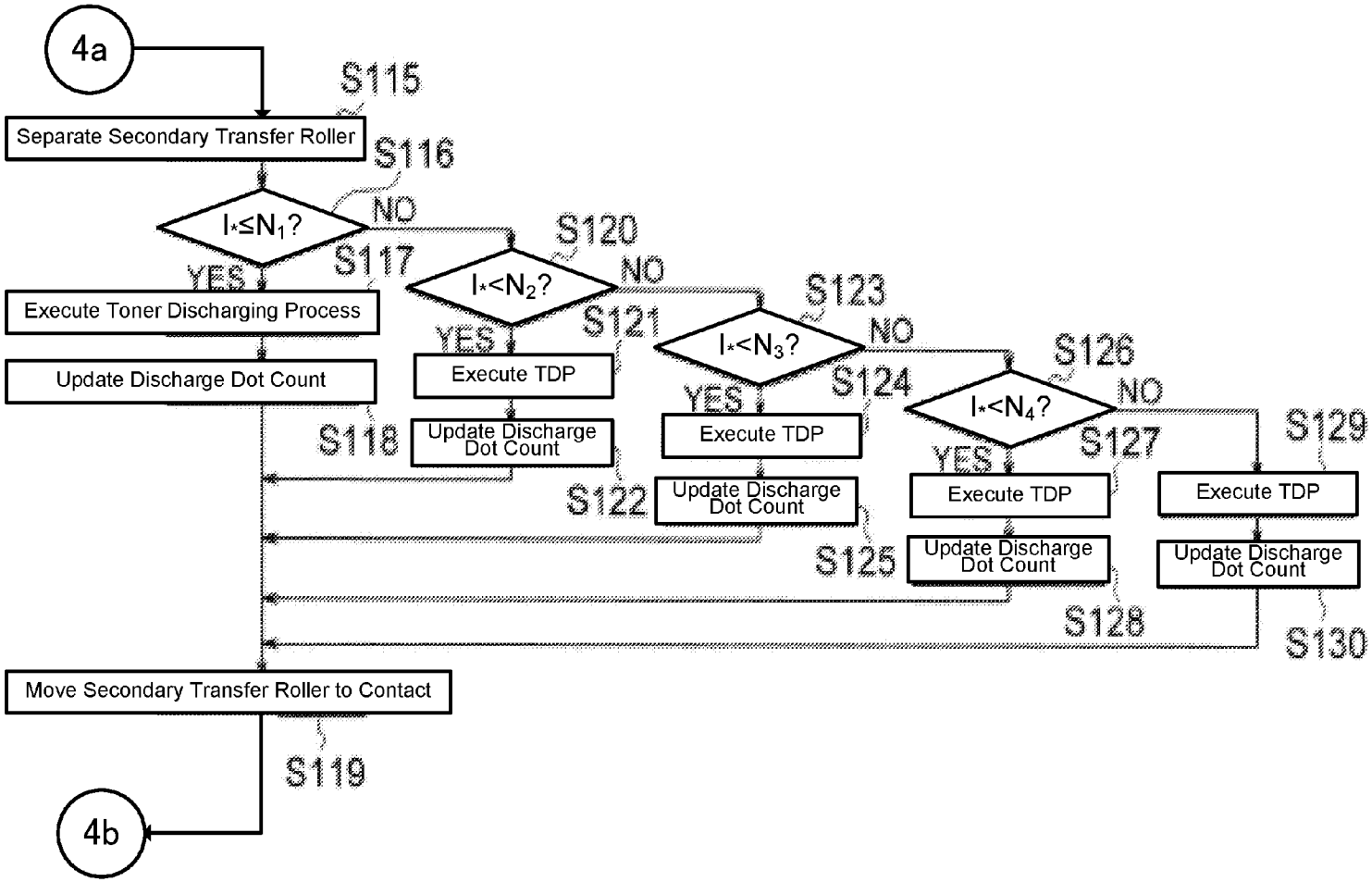

Next, the toner discharging (disposing) operation (toner discharging process) in the image forming apparatus 1 will be described. FIGS. 4A and 4B are flowcharts showing the toner discharging (disposing) operation in the image forming apparatus 1. The toner discharging operation shown in FIGS. 4A and 4B is carried out in the process execution parts 10Y, 10M, 10C, 10K, and 10W.

In the present application, the "*" in the symbols E*, F*, H*, I*, J*, R* can be replaced by the toner colors Y, M, C, K, and W used in the process execution parts 10Y, 10M, 10C, 10K, and 10W. That is, the drum count E* of the process execution parts 10Y, 10M, 10C, 10K and 10W are $E_Y$, $E_M$, $E_C$, $E_K$, and $E_W$, respectively. The light emitting dot count F* of each process execution parts 10Y, 10M, 10C, 10K and 10W is $F_Y$, $F_M$, $F_C$, $F_K$, and $F_W$, respectively. The slicing print rate (slicing duty) H* of each process execution part 10Y, 10M, 10C, 10K and 10W is $H_Y$, $H_M$, $H_C$, $H_K$, and $H_W$, respectively. That is, the discharge dot count I* of each process execution part 10Y, 10M, 10C, 10K and 10W is $I_Y$, $I_M$, $I_C$, $I_K$ and $I_W$, respectively. That is, the print dot count J* of each process execution part 10Y, 10M, 10C, 10K and 10W is $J_Y$, $J_M$, $J_C$, $J_K$, and $J_W$, respectively. That is, the slicing dot light emitting number R* of each process execution part 10Y, 10M, 10C, 10K and 10W is $R_Y$, $R_M$, $R_C$, $R_K$, and $R_W$, respectively.

The drum count E* shows the print amount executed during the print process based on one print job in each of the process execution parts 10Y, 10M, 10C, 10K and 10W. In the present embodiment, the drum count E*=1 means that the outer circumferential portion of the photosensitive drum 11 has rotated by a length of 148 [mm] in the circumferential direction (that is, corresponding to print distance=148 [mm]). The time between the print processes is the time from when the control part 60 (specifically the print control part 61) receives a print job from an external device to when the image forming on a rolled sheet P based on the received print job is completed.

The light emission dot count F* is the total value of the exposure dot number (dot light emitting number) of each light emitting element 13*a* (for example, LEDs) measured between the print processes based on one print job in each of the process execution parts 10Y, 10M, 10C, 10K, and 10W. Further, 1 [dot] corresponds to one light emitting element 13*a* (for example, LED). The dot light emitting number is the number of dots irradiated on the surface of the photosensitive drum 11 by each light emission (also referred to as "dot light emission") of the light emitting elements 13*a* of the optical head 13 (for example, LEDs). That is, the light emission dot count F* shows a cumulative value of the number of dots irradiated on the surface of the photosensitive drum 11 by the optical head 13 between the print processes based on one print job in any of the process execution parts 10Y, 10M, 10C, 10K, and 10W.

The slicing printing rate H* is a predetermined coefficient (print rate), which was set in advance, for calculating the discharge dot count I* and is a printing rate (print duty) set as a standard to determine whether or not to carry out the toner discharging operation (toner discharging process).

The discharge dot count I* is a value obtained by using the measurement result measured by the measuring part 64 between the print processes based on a print job. The specific calculation method will be described later.

The print dot count J* is a dot count [dot] when printing is performed for a print amount corresponding to drum count E*=1 at 1% duty.

The slicing dot light emitting number R* is a dot count [dot] when printing for an amount shown by the drum count E* is performed at a predetermined slicing printing rate H*. It is a value calculated by multiplying the print amount (drum count E*) measured between the printing processes based on one print job to a predetermined conversion factor.

At S101, when printing starts, the print control part 61 reads the discharge dot count I* stored in the memory part 68 at S102. When carrying out the toner discharging operation (first time) of FIGS. 4A and 4B, the discharge dot count I* stored in the memory part 68 is 0. When carrying out the toner discharging operation (second time and beyond) of FIGS. 4A and 4B, the discharge dot count I* stored in the memory part 68 is a value (count value) stored in the memory part 68 at S113 to be described later.

At S103, the measuring part 64 starts to measure the print amount being executed by the print process. Specifically, the drum rotation number measuring part 65 starts the measurement of the rotation number of the photosensitive drum 11 and counts up (adds) the drum count E* based on the measured rotation number. In this embodiment, the print amount is a length (print distance) in the carrying direction of the rolled sheet P on which printing was performed by the print process based on one print job. In this embodiment, "1" is added to the drum count E* when the outer circumferential portion of the photosensitive drum 11 rotates for a length of 148 [mm] in the circumferential direction in the print process. That is, in this embodiment, the drum count E* is shows the print amount. Further, the initial value of the drum count E* is 0. The print control part 61 receives the drum count E*.

In this embodiment, the print amount is set to the length (print distance) of the printed rolled sheet P in the carrying direction, but the rotation number of the photosensitive drum 11 in the print process based on one print job can be set as the print amount.

At S104, the dot light emitting number measuring part 66 starts to measure the exposure dot number (dot light emission number) of each LED of the optical head 13 and counts up (adds) the light emitting dot count F*. In this embodiment, for example, "1" is added to the light emission dot count F* when one LED of the optical head 13 emits 1 dot of light.

At S105, the print data monitoring part 62 checks whether or not the light emission by the LED of the optical head 13 based on the head light emission command data D1 is completed (that is, whether or not the print process based on one print job is complete), and when it is not completed, it repeats the process of Step S105 until the print process based on one print job is completed. While the process At S105 is repeated, the drum count E*, a value showing the print distance, and the light emission dot count F* showing the dot light emitting number is continuously added accordingly with the print operation.

At S105, in a case in which the print process based on one print job is determined to be completed (YES at S105), the measurement of the drum count E* is completed at S106 and the measurement of the light emission dot count F* is completed at S107. That is, the measurement of the print amount by the measuring part 64 in the print process is executed for every print job.

At S109, the control part 60 (specifically, the calculation part 63) calculates the discharge dot count I* as a value for calculating the toner discharging amount from the drum count E*, which is a value showing the print amount (for example, print distance), the light emission dot count F* showing the dot light emitting number, and the slicing printing rate H*.

Here, the print dot count J* will be described. In an A6 size sheet, the length in the main scanning direction is 105 [mm] and the length in the sub-scanning direction is 148 [mm]. That is, in this embodiment, an A6 size sheet is a print amount corresponding to a drum count E*=1 (print distance=148 [mm]). For the printing, the top, bottom, left, and right margins are 2 [mm]. In this case, the area of the printable region of the A6 size sheet [$mm^2$] can be shown by the following formula.

$$(105-(2\times2))\times(148-(2\times2))[mm^2] \quad \text{Formula 1}$$

When the entire printable region is irradiated with the dot-shaped lights at a printing rate of 100% (when all LEDs are irradiated, the irradiation dot number (dot light emitting number) in the main scanning direction is shown by the formula 2 and the irradiation dot number (dot light emitting number) in the sub-scanning direction is shown by the formula 3.

$$(105-(2\times2))/25.4\times1200=4771.6535\ [dots] \quad \text{Formula 2}$$

$$(148-(2\times2))/25.3\times1200=6803.1496\ [dots] \quad \text{Formula 3}$$

Here, 25.4 [mm/inch] is a conversion of units inches and millimeters, and 1200 [dot/inch] is the number of LEDs per 1 inch of LED arrays of the optical heads 13.

The print dot count J* (1% duty) is shown by the following formula 4 when a region of only 1% of the area among the entire printable area is irradiated with dot-shaped lights.

$$J^*=4771.6536\times6803.1496\times0.01=324622.726\ [dots] \quad \text{Formula 4}$$

The number of dot-shaped lights J* is 324622 [dots] when the decimal points are rounded off. The value J* is a dot count when printing at a printing rate of 1% is performed on one A6 size sheet (corresponding to drum count E*=1).

Therefore, for example, the print dot count J* (5% duty) =J5* when printing at a printing rate of 5% is performed on one A6 size sheet is shown by the following formula 5, and the print dot count J* (10% print duty)=J10* when printing at a printing rate of 10% is performed on one A6 size sheet is shown by the following formula 6.

$$J5^*=J1^*\times5=324622\times5\ [dots] \quad \text{Formula 5}$$

$$J10^*=J1^*\times5=324622\times10\ [dots] \quad \text{Formula 6}$$

Next, the slicing printing rate H* will be described. The slicing printing rate H* a printing rate (print duty) set as a standard on whether or not to carry out the toner discharging operation (toner discharging process). When a state in which the toner is not consumed continues, deteriorated toners with changed properties increase around the development roller 143 and become the cause of occurrences of print contamination. Therefore, when the printing rate (print duty) is low, it is preferable to carry out the toner discharging process (discharge process) for discharging the deteriorated toner. When the print process is executed at a printing rate below the slice printing rate H*, the toner discharge process is executed after the completion of the print process. In Embodiment 1, the slicing printing rate H* is set to 5%. Not to mention, the rate H* may vary according to various conditions. The rate H* may be determined to be within 0% to 20%.

The calculation method of the discharge dot count I* (discharge dot count value) for calculating the toner discharging amount will be described.

First, the control part 60 calculates the slicing dot light emitting number R* using the following formula in which the dot count E* is multiplied by the conversion factor.

$$R^*=J^*\times(H^*\times100)\times E^*$$

Instead of using dot count E*, a drum rotation time (or period) may be available.

Next, the control part 60 calculates the discharge dot count I* by the difference in the light emission dot count F* and the slicing dot light emitting number R* (formula 7) in the print process based on the most recent print job.

$$I^*=R^*=F^* \quad \text{Formula 7}$$

The discharge dot count I* read at S102 is added to the calculated discharge dot count I* to update the discharge dot count I* used in the toner discharging process. When the discharge dot count I* has a positive value, it means that deteriorated toner exists in the casing 141 from the continuation of low duty printing, for example.

At S110, the control part 60 determines whether or not the discharge dot count I* updated at S109 is 0 or lower. It is the same as determining whether or not deteriorated toner exists in the casing 141. When the discharge dot count I* (YES at S110) is 0 or lower, the drum count E* is set to 0 [counts] at S111 (or reset the drum count), the light emitting dot count F* is set to 0 [counts] at S112 (or reset the light emitting dot count F*), and the discharge dot count I* is set to 0 [counts] at S113 to store the discharge dot count I* in the memory part 68. At this time, the value of the stored discharge dot count I* is 0 [counts]. And the print operation is completed at S114.

At S110, when the discharge dot count I* updated at S109 is determined to be larger than 0 [counts] (NO at S110), the control part 60 starts the execution of the toner discharging process. Specifically, the control part 60 (print control part 61) makes the process execution part 10 execute the toner discharging process between after the print process (first print process) based on the most recent print job (first print job) is completed and until the print process (second print process) based on the next print job (second print job) is started.

At S115, according to the control signal of the control part 60, the separating operation control part 81 drives the secondary transfer roller cam 81*a* to separate the secondary transfer roller 54 from the intermediate transfer belt 31.

At S116, the control part 60 determines whether or not the discharge dot count I* is below the predetermined first standard dot count $N_1$ [counts]. The first standard dot count $N_1$ is, for example, 588779520 [counts]. The first to fourth standard dot counts $N_1$ to $N_4$ are determined based on lengths by which the control part 60 is able to continue to print without wasting toners. From the first to the fourth, the counts increase.

When the discharge dot count I* is below the first standard dot count $N_1$ (YES at S116), at S117, the control part 60 (for example, the print control part 61) makes each part including the process execution part 10 execute the toner discharging process based on the discharge dot count I*. The discharge amount of the toner is calculated by multiplying the discharge dot count I* by the amount of toner supplied to the photosensitive drum 11 from the development part 14 by the light emission (dot light emission) of one light emitting element 13*a* in a plurality of light emitting elements 13*a* in the optical heads 13. That is, the control part 60 (for example, the print control part 61) makes the optical head 13 execute the dot light emission based on the discharge dot count I*, and an amount of toner to be discharged is discharged from the development part 14. Specifically, an amount of toner to be discharged is supplied to the photosensitive drum 11 from the development part 14. The toner (waste toner) supplied to the photosensitive drum 11 is removed by the cleaning member 15 or the belt cleaning member 38 and accommodated by the waste toner accommodation part 140*b* or 24.

Since all deteriorated toner to be discarded may be regarded to be discharged at S117, at S118, the control part 60 updates the discharge dot count I* to 0 [counts] (that is, the discharge dot count I* is overwritten to 0 [counts]). Further, the first standard dot count $N_1$ is not limited to the aforementioned value.

At 116, when the discharge dot count I* is the first standard dot count $N_1$ or larger (NO at S116), at S120, the control part 60 determines whether or not the discharge dot count I* is below the predetermined second standard dot count $N_2$ [counts]. The second standard dot count $N_2$ is a value larger than the first standard dot count $N_1$ The second standard dot count $N_2$ is, for example, a value twice the first standard dot count $N_1$ [count], that is, 1177559040 [counts]. When the discharge dot count I* is below the second standard dot count $N_2$ (YES at S120), at S121, the control part 60 (for example, the print control part 61) makes each part including the process execution part 10 execute the toner discharging process based on the discharge dot count I*. In FIG. 4B, the process is simply shown as Execute TDP. Other processes at S124, S127 and S129 are the same. The discharge amount of the toner is calculated by multiplying the standard dot count value (first standard dot count $N_1$) by the amount of toner supplied to the photosensitive drum 11 from the development part 14 by the light emission (dot light emission) of one light emitting element 13*a* in a plurality of light emitting elements 13*a* in the optical head 13. That is, the control part 60 (for example, the print control part 61) makes the optical head 13 execute the dot light emission based on the first standard dot count $N_1$, and an amount of toner to be discharged is discharged from the development part 14.

Since a part of the deteriorated toner to be discarded is considered to be discharged at S121, at S122, the control part 60 updates the discharge dot count I* to ($I^*-N_1$) [counts]=(I*−588779520) [counts] (that is, the discharge dot count I* is overwritten to ($I^*-N_1$) [counts]). Further, the second standard dot count $N_2$ is not limited to the aforementioned value.

At 120, when the discharge dot count I* is the second standard dot count $N_2$ or larger (NO at S120), at S123, the control part 60 determines whether or not the discharge dot count I* is below the predetermined third standard dot count $N_3$ [counts]. The third standard dot count $N_3$ is a value larger than the second standard dot count $N_2$ [counts]. The third standard dot count $N_3$ is, for example, a value three times the first standard dot count N1 [count], that is, 1766338560 [counts]. When the discharge dot count I* is below the third standard dot count $N_3$ (YES at S123), at S124, the control part 60 (for example, the print control part 61) makes each part including the process execution part 10 execute the toner discharging process based on the second standard dot count $N_2$. The specific calculation method of the toner discharging amount is same as the calculation method at S121.

Since a part of the deteriorated toner to be discarded is considered to be discharged at S124, at S125, the control part 60 updates the discharge dot count I* to ($I^*-N_2$) [counts]=(I*−1177559040) [counts] (that is, the discharge dot count I* is overwritten by ($I^*-N_2$) [counts]). Further, the third standard dot count $N_3$ is not limited to the aforementioned value.

At 123, when the discharge dot count I* is the third standard dot count $N_3$ or larger (NO at S123), at S126, the control part 60 determines whether or not the discharge dot count I* is below the predetermined fourth standard dot count $N_4$ [counts]. The fourth standard dot count $N_4$ is a value larger than the third standard dot count $N_3$ [counts]. The fourth standard dot count $N_4$ is, for example, a value four times the first standard dot count $N_1$ [count], that is, 2355118080 [counts]. When the discharge dot count I* is below the fourth standard dot count $N_4$ (YES at S126), at S127, the control part 60 (for example, the print control part 61) makes each part including the process execution part 10 execute the toner discharging process based on the third standard dot count $N_3$. The specific calculation method of the toner discharging amount is same as the calculation method at S121.

Since a part of the deteriorated toner to be discarded is considered to be discharged at S127, at S128, the control part 60 updates the discharge dot count I* to ($I^*-N_3$) [counts]=(I*−1766338560) [counts] (that is, the discharge dot count I* is overwritten by ($I^*-N_3$) [counts]). Further, the fourth standard dot count $N_4$ is not limited to the aforementioned value.

When the discharge dot count I* is above the fourth standard dot count $N_4$ (NO at S126), at S129, the control part 60 (for example, the print control part 61) makes each part including the process execution part 10 execute the toner discharging process based on the fourth standard dot count $N_4$. The specific calculation method of the toner discharging amount is same as the calculation method at S121.

Since a part of the deteriorated toner to be discarded is considered to be discharged at S129, at S130, the control part 60 updates the discharge dot count I* to ($I^*-N_4$) [counts]=(I*−2355118080) [counts] (that is, the discharge dot count I* is overwritten by ($I^*-N_4$) [counts]).

After the toner discharging is executed and the discharge dot count I* are updated at S118, S122, S125, S128, and S130, the secondary transfer roller 54 is moved at S119 by the separating operation control part 81 to come into contact with the intermediate transfer belt 31 so that the next print operation can be performed.

At S111, the measuring part 64 resets the drum count E* to 0 [counts] and resets the light emitting dot count F* to 0 [counts] at S112.

At S113, the control part 60 stores the discharge dot count I* in the memory part 68 and carries over the value of the discharge dot count I* at the time of Step S113 to the time of the execution of the next toner discharging process. The print operation is completed at S114.

Next, the toner discharging operation (toner discharging process) in this embodiment will be described. At the time of executing the toner discharging operation, the bias applied to the primary transfer roller 40, the charge roller 12, the development roller 143, the supply roller 142, and the development blade 144 is the same bias as in the printing step. The whole surface of the discharging light irradiation part 16 is exposed, and continuously emits light until the dots for the toner discharging as instructed in each of Step S117, Step S121, Step S124, Step S127, and Step S129 are consumed. The drive motor control part 79 drives the intermediate transfer belt 31 and the photosensitive drum 11 but does not drive the secondary transfer roller 54 since it is separated. The operation of the heat application roller 55*a* and the pressure application roller 55*b* by the fusing control part 77, the operations of the rolled sheet feeder 51 by the carrying motor control part 78, and the operations of the cutter 53 by the cutter operation control part 80 are also not performed so that the sheet feeding operation is not performed.

The movement of the toner at the time of toner discharging operation will be described. In the exposure process by the optical head 13, by executing the dot light emission based on the standard dot count value (for example, the discharge dot count I*), first, toner is supplied (discharged) to the photosensitive drum 11 from the development device. The discharged toner on the photosensitive drum 11 is transferred to the intermediate transfer belt 31, and since the secondary transfer roller 54 is separated, the discharged toner is scraped from the intermediate transfer belt 31 by the belt cleaning member 38 and accommodated in the waste toner collection part 24. However, the discharged toner on the photosensitive drum 11 can be removed by the cleaning member 15 and accommodated by the waste toner accommodation part 140*b*.

When the discharge dot count I* is larger than a value of 0 [counts] in a plurality of colors, the discharging operation is performed simultaneously at process execution parts 10 having a value of 0 or larger.

In the image forming apparatus 1, when the image data of the next print job is received by the image data converter 67 during a print process based on one print job, the print operation of the second print job and the discharging operation are performed after the aforementioned print operation and the toner discharging operations are over.

Figure 5:
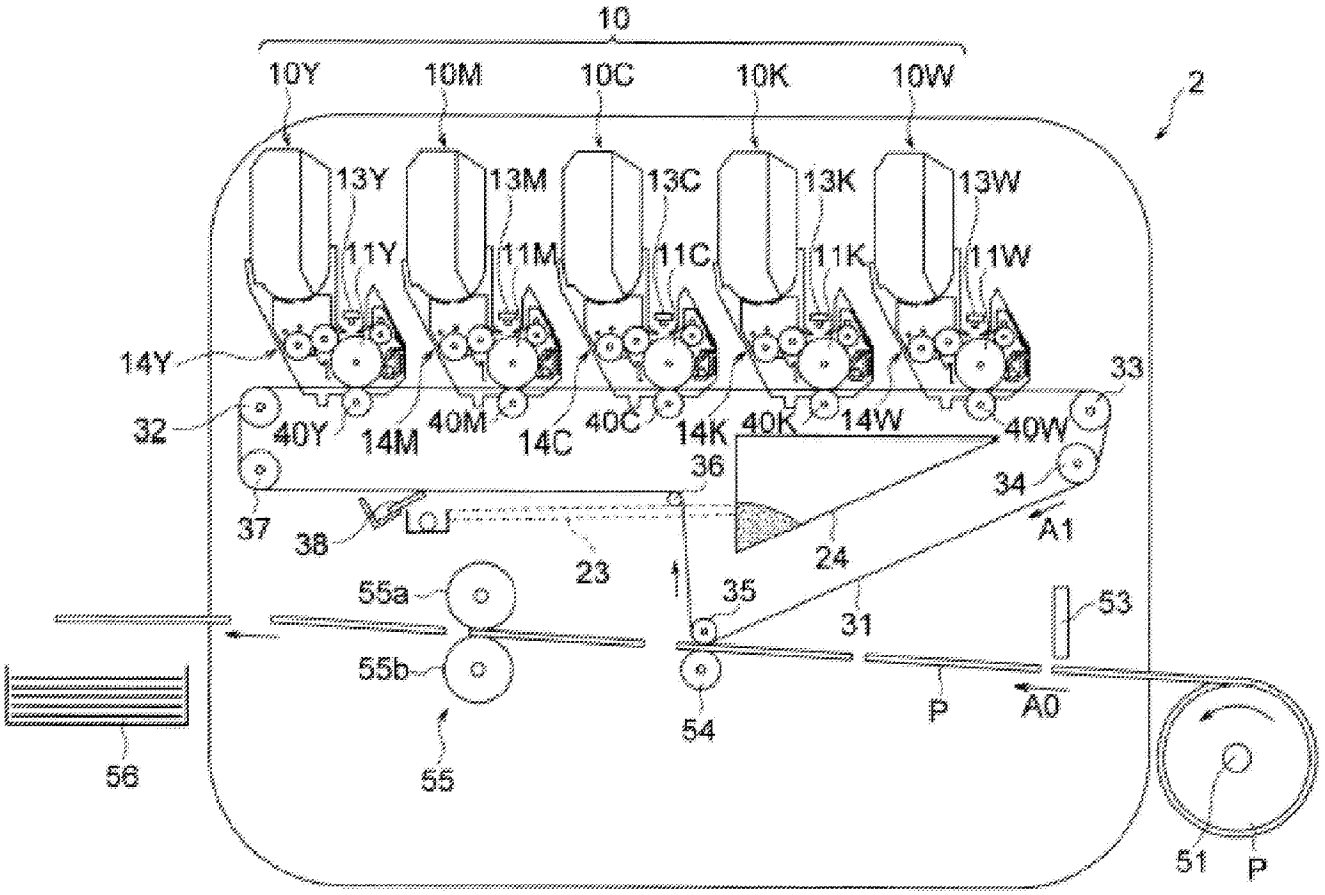
FIG. 5 is a vertical cross-sectional view schematically showing a configuration of the image forming apparatus according to a Comparative Example.

Next, using FIG. 5, the operation of the print step in Comparative Example will be described. FIG. 5 is a vertical cross-sectional view schematically showing a configuration of the image forming apparatus according to Comparative Example. The image forming apparatus 2 is different from the image forming apparatus 1 in that it is not provided with a rewinder 52 but provided with a stacker 56. As in the image forming apparatus 2, a printing embodiment in which a rolled sheet P is cut by a cutter 53 every few hundred [mm] and sheets are accommodated in the stacker 56 is called "roll to sheet printing" (roll-to-sheet printing). Other configurations (including control systems) are the same as the image forming apparatus 1.

The head light emission command data of the first print job is shown as D1, and the head light emission command data of the second print job is shown as D2, and similarly so forth. The other operations (print process and the toner discharging process) are basically the same as the operations of the image forming apparatus 1.

Figure 6:
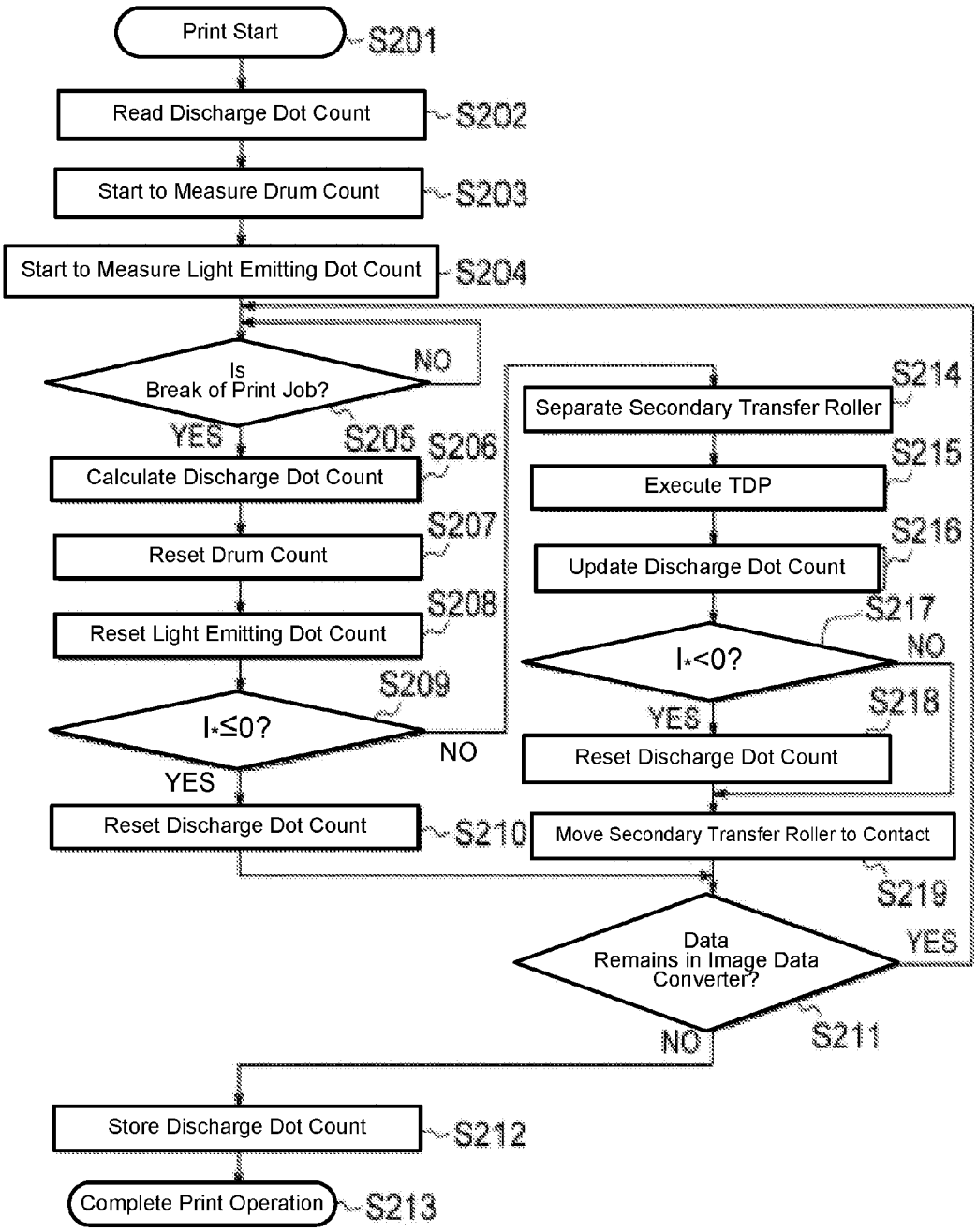
FIG. 6 is a flowchart showing an operation of the image forming apparatus according to the Comparative Example.

FIG. 6 is a flowchart showing an operation of the image forming apparatus according to Comparative Example. Next, the toner discharging control operation in Comparative Example will be described using the flowchart shown in FIG. 6. The flowchart of FIG. 6 is carried out independently in each process execution part 10Y, 10M, 10C, 10K, and-lOW, and the "*" in the flowchart represents Y, M, C, K, and W (each color).

At S201, when printing starts, the print control part 60 reads the discharge dot count I* from the memory part 68 at S202. Further, the discharge dot count I* is 0 [count] when the process shown in FIG. 6 is carried out for the first time (first execution), but for the second time and thereafter, the value stored in the memory part 68 is used. The meaning of the discharge dot count I* is the same as in the image forming apparatus 1.

At S203, the drum rotation number measuring part 65 starts the measurement of the rotation number of the photosensitive drum 11 and adds as a drum count E*. In this Comparative Example, for example, 1 is added to the drum count E* when the outer circumferential portion of the photosensitive drum 11 rotates by a length of 148 [mm] in the circumferential direction in the print process. Further, the initial value of the drum count E* is 0.

At S204, the dot light emitting number measuring part 66 starts to measure the exposure dot number (dot light emission number) of the LEDs of the optical head 13 and adds them up as the light emitting dot count F*. In this Comparative Example, for example, 1 is added to the light emission dot count F* when one LED of the optical head 13 emits 1 dot of light.

At S205, the print data monitoring part 62 checks whether or not it is a break of the print job, and when it is not a break, Step S205 is repeated until it becomes a break of the print job (that is, until one print job is completed). Herein, the break of the print job is determined by finding that the next print job D0 has not been delivered when the emission of the head light emission command data D1 is completed. While the process at S205 is repeated, the drum count E* and the light emission dot count F* are continuously added according to the print operation.

When the print data monitoring part 62 detects a break of the print job (YES at S205), the discharge dot count I* is calculated using a similar method as at S109 at S206. After that, at S207, the drum count E* is set to 0 [counts] and the light emitting dot count F* is set to 0 [counts] at S208. In FIG. 6, these processes are recited as "Reset"

At S209, the control part 60 determines whether or not the discharge dot count I* is 0 [counts] or larger, and in case of 0 or smaller (YES at S209), at S210, the discharge dot count I* is reset to 0 [count].

At S211, the control part 60 confirms whether or not data remains in the image data converter 67, and when there is no data remaining (NO at S211), it shifts to Step S212 and stores in the memory part 69 that the discharge dot count I* is 0 [count] and completes the printing at S213.

At S209, when the discharge dot count I* has a value that is larger than 0 (NO at S209), the control part 60 separates the secondary transfer roller 54 from the intermediate transfer belt 31 at S214.

Next, at S215, the control part 60 makes the optical head 13 execute the dot light emission for 154828800 [dots] that was set in advance and executes the toner discharging process (or Execute TDP at S215 in FIG. 6).

At S216, 154828800 [counts] are subtracted from the discharge dot count at the time of Step S216 (updates the discharge dot count I*).

At S217, when the discharge dot count I* obtained at S216 is 0 or smaller (YES at S217), at S218, the discharge dot count I* is reset to 0 [count].

At S219, the control part 60 makes the secondary transfer roller 54 come in contact with the intermediate transfer belt 31 and shifts to Step S211.

At S211, the control part 60 checks whether or not the head light emission command data D1 remains in the image data converter 67. When there is no head light emission command data D1 remaining (NO at S211), it shifts to Step S212, and when the head light emission command data D1 remains (YES at S211), it returns to Step S205).

<<1-4>> Evaluation Experiment

In the image forming apparatus of Comparative Example, when the discharge dot count I* is a value of 0 [counts] or larger, the toner discharging process is executed for every period between a print process based on a print job and a print process based on the next print job (break of print process), and the toner discharging amount in this toner discharging process is a constant amount that is not dependent on the discharge dot count I*.

Hereinafter, the evaluation and the results for confirming the effects of this embodiment by the toner discharging process (the toner discharging control shown in FIGS. 4A and 4B) will be shown. In this evaluation, after performing continuous printing under various conditions, halftone images were printed by dot forming and the occurrences of contamination were checked visually. Specifically, continuous printing was performed under the following conditions (Embodiment, Comparative Example). Further, when the print distance is referred in "rolls", it shows the roll number of the rolled sheet when a rolled sheet having a length of 300 [m] for one roll is used as a print medium, and one print job is one roll. Only Experimental Example #10 (Comparative Example) performs roll-to-sheet printing, and one print job is a print job on 500 A6 size sheets.

Further, the method in which halftone images are printed by dot forming and the occurrences of contamination are checked visually will be described. In a halftone image, since the intervals of dots are narrow and the electrostatic latent images by dots on the photosensitive drum 11 are not isolated, the electrostatic latent image of the photosensitive drum 11 by dot forming overlap with the electrostatic latent image by dots around them. The surface electrical potential −500 [V] of the photosensitive drum 11 that should originally be white becomes larger, for example, −400 [V] from the overlapping of electrostatic latent image. And when the development roller 143 in which deteriorated toner is adhered on the perimeter and the photosensitive drum 11 come in contact by the rotation, the electrical potential by the development roller 143 and the deteriorated toner comes closer to −400 [V] of the photosensitive drum 11, and halftone smear occurs, which is a smear in which the deteriorated toner is transferred to the overlapping part of the electrostatic latent image of the dots on the photosensitive drum 11.

In this way, the determination of contamination when halftone printing is performed is judged based on whether or not toner that should not be adhered is adhered between the dots in the halftone images, and it is judged to have a smear (×) when the adherence of the toner between the dots is seen. When no toner adhered between the dots, it is judged to have no smear (○).

FIG. 7 shows the a configuration, a discharge process, a printing rate (print duty), a print distance, and the result of smear judgment for the image forming apparatus according to Embodiment 1 (Experimental Examples #1 to #5) and the image forming apparatus of Comparative Example (Experimental Examples #6 to #11). Those experimental examples #1 to #5 are related to the invention.

Figure 8:
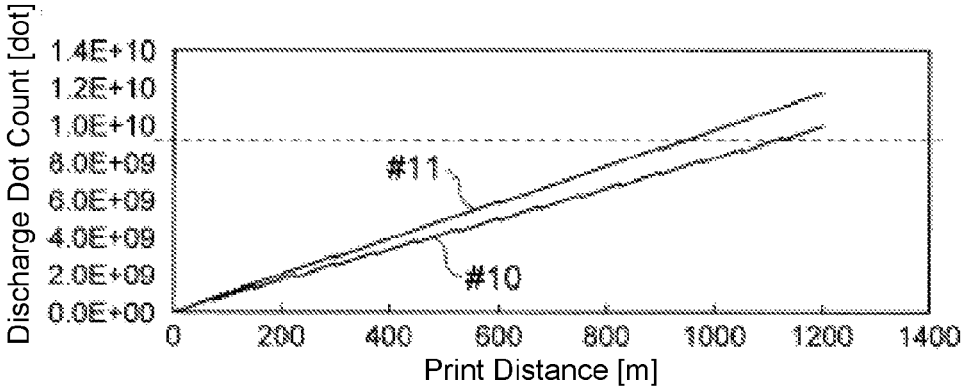
FIG. 8 shows the relationship between the print distance [m] and the discharge dot count [dots] in the print process in the image forming apparatus of the Comparative Example (Experimental Examples #10, #11).

FIG. 8 shows the relationship between the print distance [m] and the discharge dot counts I* [counts] in the print process in the image forming apparatus of Comparative Example (Experimental Example #10, #11). In FIG. 8, the discharge dot count when a halftone smear is generated is shown with a dotted line. In the roll-to-sheet printing, the toner discharging process is executed once per printing of 500 sheets of A6 size sheet (print distance of 75 [m]). On the other hand, in the roll-to-roll printing, since the toner discharging process is executed once per printing of a roll (printing distance of 300 [m], the number of execution of the toner discharging process is less than the roll-to-sheet printing. Therefore, in roll-to-roll printing, the discharge dot count I* is more likely to increase. For example, in the configuration of the process execution part 10 of this embodiment, when 3 rolls of rolled sheet (print distance 900 m) are subjected to continuous printing at 0.3% duty (toner discharging process is not executed), halftone smear occurs. The discharge dot count I* when the halftone smear occurs is, for example, 9088450560 [counts] ($\approx 9.1\times10^9$ [counts]).

Figure 9:
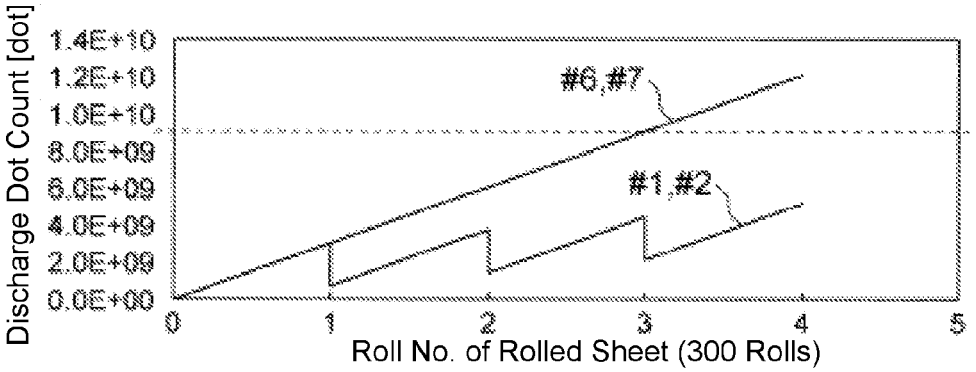
FIG. 9 shows the relationship between the print distance [the roll number of a 300 m rolled sheet] and the discharge dot count [dots] in the print process in the image forming apparatus according to Embodiment 1 (Experimental Examples #1, #2) and the image forming apparatus of the Comparative Example (Experimental Examples #6, #7).

FIG. 9 shows the relationship between the print distance [the roll number of a 300 m rolled sheet] and the discharge dot count [counts] in the print process in the image forming apparatus according to Embodiment 1 (Experimental Examples #1, #2) and the image forming apparatus of the Comparative Example (Experimental Examples #6, #7). In FIG. 9, the discharge dot count when a halftone smear is generated is shown with a dotted line. When continuous printing (the toner discharging process is not executed) is performed at 0.3% duty, as described above, a halftone smear occurs after the third roll, so in the second roll of Experimental Example #6 (Comparative Example), smearing did not occur, and in the fourth roll of the Experimental Example #7, smearing occurs. On the other hand, in Experimental Example #1 (Embodiment) and Experimental Example #2 (Embodiment) with toner discharging, the discharge dot count I* at the time of completing the printing after the first roll was 3029120026 [counts], and the toner discharging process of Step S129 in FIG. 4B is executed. Since the toner discharging process of Step S129 is carried out after the second roll, as seen in Experimental Example #2 (Embodiment) at the time of completing the fourth roll, the halftone smear did not occur.

Figure 10:
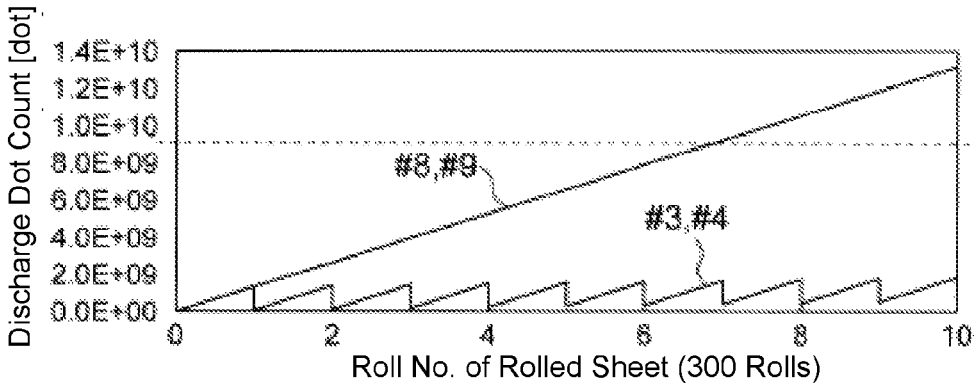
FIG. 10 shows the relationship between the print distance [the roll number of a 300 m rolled sheet] and the discharge dot count [dots] in the print process in the image forming apparatus according to Embodiment 1 (Experimental Examples #3, #4) and the image forming apparatus of the Comparative Example (Experimental Examples #8, #9).

FIG. 10 shows the relationship between the print distance [the roll number of a 300 m rolled sheet] and the discharge dot count [counts] in the print process in the image forming apparatus according to Embodiment 1 (Experimental Examples #3, #4) and the image forming apparatus of Comparative Example (Experimental Examples #8, #9). In FIG. 10, the discharge dot count when a halftone smear is generated is shown with a dotted line. When continuous printing (the toner discharging process is not executed) is performed at 0.3% duty without toner discharging, as described above, a halftone smear occurs in the middle of the eighth roll, so in the sixth roll of Experimental Example #8 (Comparative Example), smearing did not occur, and in the tenth roll of Experimental Example #9, smearing occurred. On the other hand, in Experimental Example #3 (Embodiment) and Experimental Example #4 (Embodiment) in which the toner discharging process is executed, the discharge dot count I* at the time of completing the printing after the first roll was 1289016983 [counts], and the toner discharging process of Step S124 in FIG. 4B is executed. The toner discharging process of Step S124 is carried after the second roll up to the fifth roll. The discharge dot count I* at the time of completing the printing after the sixth roll was 1846306699 [counts], and the toner discharging process of Step S127 in FIG. 4B is executed. For the toner discharging process from the seventh roll up to the ninth roll, a toner discharging process of Step S124 is executed. At this time, as seen in Experimental Example #4 (Embodiment), there is no occurrence of the halftone smear after the completion of the tenth roll.

Experimental Example #5 (Embodiment) is a case in which the toner discharging process is executed at 5% duty. In Experimental Example #5, since the discharge dot count I* does not increase, the toner discharging process is not carried out and there is no smearing. When comparing Experimental Examples #1 and #2 (Embodiment), Experimental Examples #3 and #4 (Embodiment), and Experimental Examples #5 (Embodiment), Experimental Examples #3 and #4 are higher duty printing than Experimental Examples #1 and #2 (Embodiment). Further, the Experimental Example #5 (Embodiment) is higher duty printing when compared to Experimental Examples #3 and #4 (Embodiment). Further, the toner discharging amount at the time of the completion of printing the first roll is less for Experimental Examples #3 and #4 (Embodiments) than Experimental Examples #1 and #2 (Embodiments). Further, the toner discharging amount at the time of the completion of printing the first roll is less for Experimental Example #5 (Embodiment) than Experimental Examples #3 and #4 (Embodiments).

<<1-5>> Effects

As described above, according to Embodiment 1, since the toner discharging process (discharge of the deteriorated toner) is executed every time a print process based on one print job is completed, the quality of the printed images can be improved.

In the toner discharging process, when a low printing rate printing continued for a long time, the amount of toner discharged from the development part 14 is controlled to increase, so the deteriorated toner in the development part 14 can be sufficiently discharged.

When a high printing rate printing is executed, the amount of toner discharged from the development part 14 is controlled to decrease, so the discharging of the deteriorated toner can be effectively performed.

<<2>> Embodiment 2

<<2-1 >> Configuration of the Image Forming Apparatus

The basic configuration of an image forming apparatus 2 is the same as Embodiment 1. For this reason, in describing Embodiment 2, FIGS. 1 to 3 will be referred.

<<2-2>> Operation of The Image Forming Apparatus

Figure 11A:
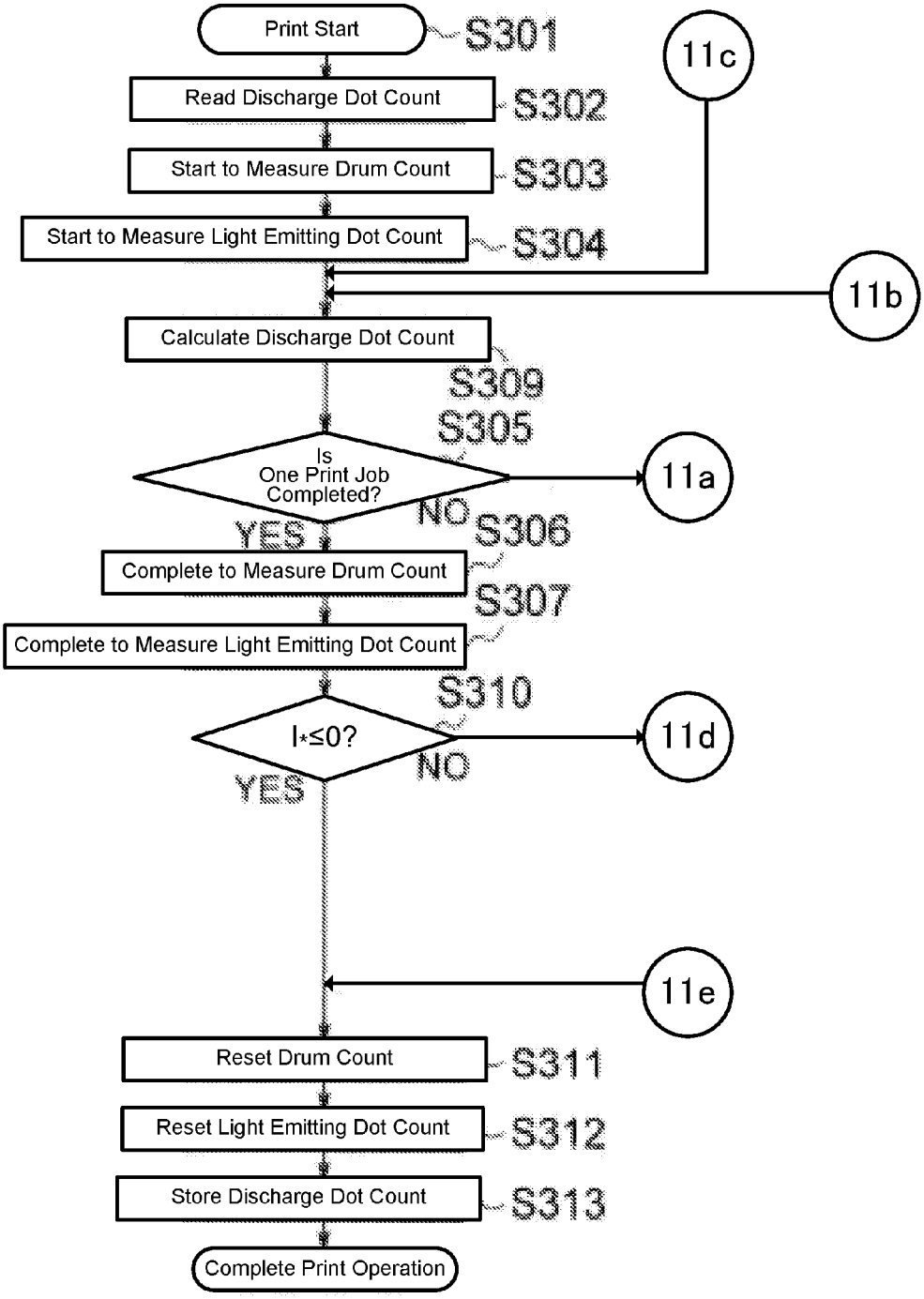
FIGS. 11A and 11B are flowcharts showing an operation of the image forming apparatus according to a second embodiment of the present invention.
Figure 11B:
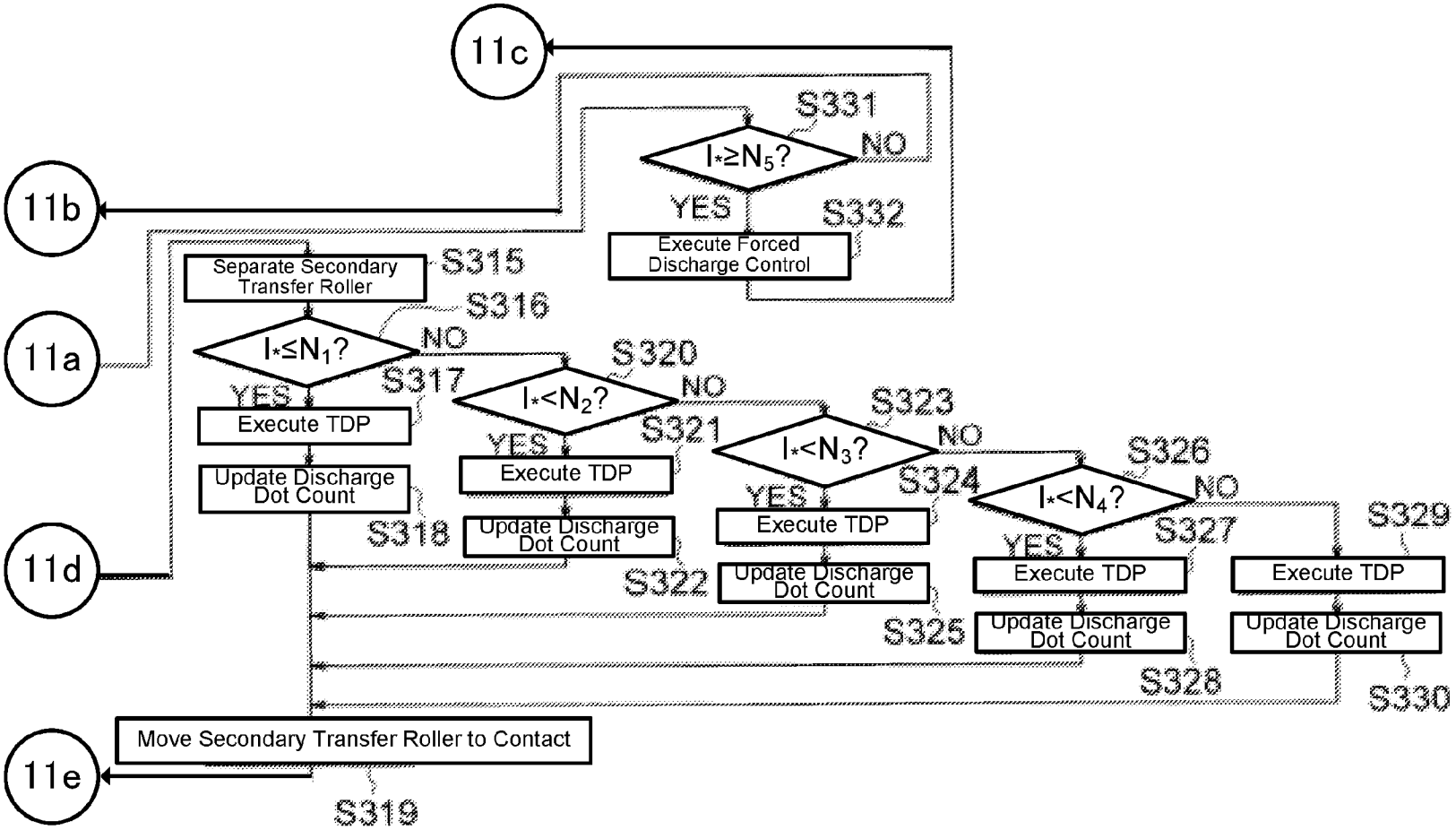

FIGS. 11A and 11B are flowcharts showing an operation of the image forming apparatus according to Embodiment 2. The operation of the print process of the image forming apparatus of Embodiment 2 and that of the toner discharging process are basically the same as the operation of the image forming apparatus 1 according to Embodiment 1 as shown in FIGS. 4A and 4B. Therefore, S301-S307, S310-S313 and S315-S330 in FIGS. 11A and 11B correspond to S101-S107, S110-S113 and S115-S130 in FIGS. 4A and 4B, respectively. In Embodiment 2, the differences compared to the operation of the image forming apparatus 1 according to Embodiment 1 will be described.

The process shown in FIGS. 11A and 11B is different from the process of Embodiment 1 (FIGS. 4A and 4B) as described in the following. The first difference is that the calculation of the discharge dot count I* of Step S109 in Embodiment 1 is performed before the completion of the print process based on one print job, that is, while the print process based on one print job is being carried out (Step S309). The second difference is that, in Embodiment 1, the toner discharging process is executed after the completion of the print process based on one print job (Step S105), but in Embodiment 2, the forced discharge control (forced discharge process) (Step S332) is executed at the time it is determined that the discharge dot count I* has exceeded a predetermined threshold value (Step S331) even if the print process based on one print job is not completed (Step S305). Hereinafter, the conditions in which the forced discharge control is executed will be described.

At S305, when the control part 60 determines that a print process based on one print job has not yet be completed (NO at S305), at S331, the control part 60 further determines whether or not the discharge dot count I* is a predetermined threshold value $N_5$ or higher (for example, 2355118080 [count]). When the discharge dot count I* is below the threshold value $N_5$ (for example, 2355118080 [count]) (NO at S331), it shifts to Step S309 and the print process is continued. When the discharge dot count I* reaches the threshold value $N_5$ (for example, 2355118080 [count]) (YES at S331), at S332, the forced discharge control described below will be performed. After the completion of the forced discharge control, it goes back to Step S309 and the print process is continued. The threshold value $N_5$ is also determined in the same fashion as the first to fourth standard dot counts $N_1$ to $N_4$ are determined. The value $N_5$ is determined such that the value is to be smaller than a discharge dot count at a timing when a halftone smear is generated, see FIG. 8. The value $N_5$ is not necessarily equal to the fourth standard dot count $N_4$, but it is preferred that value $N_5$ is equal to or larger than the maximum value among the first to fourth standard dot counts $N_1$ to $N_4$. Namely, the following formula is satisfied:

$$N_5 \geq \max(N_1, N_2, N_3, N_4)$$

Figure 12:
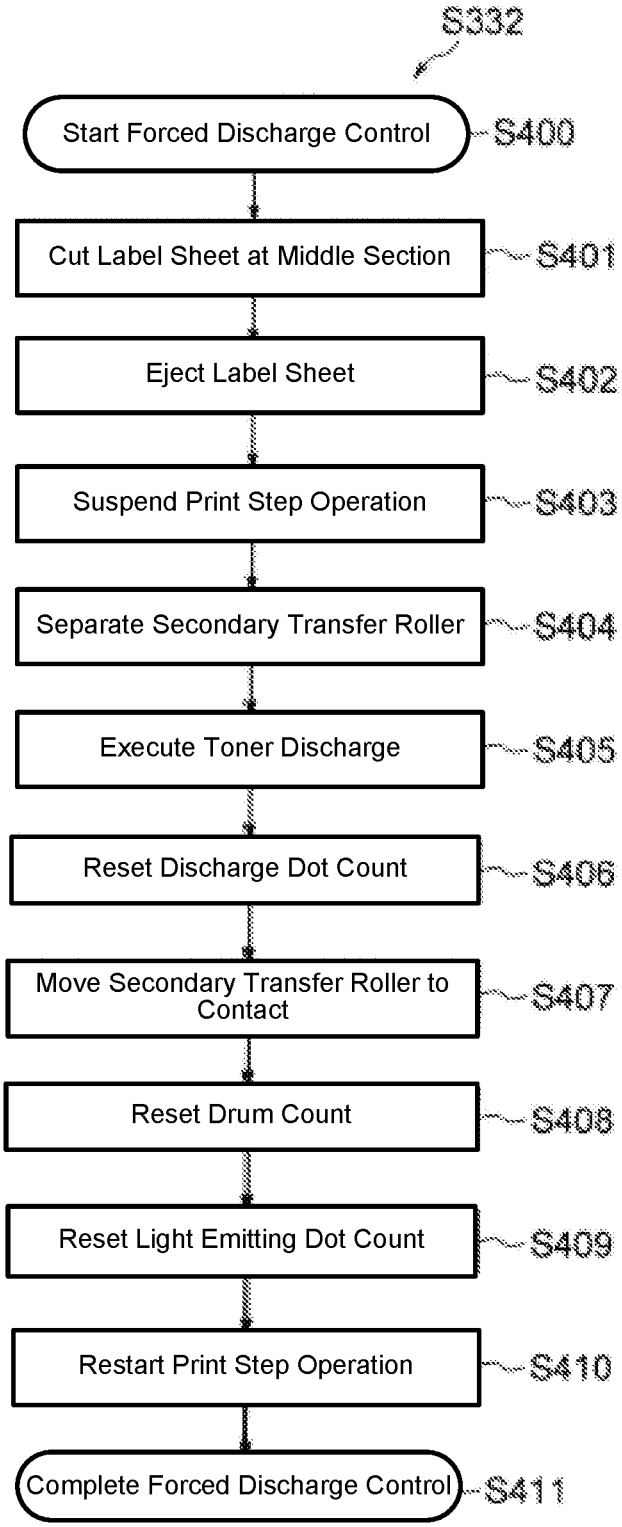
FIG. 12 is a flowchart showing the details of a forced discharge control shown in FIGS. 11A and 11B.

FIG. 12 is a flowchart showing the operation of the forced discharge control (Step S332) in detail, in which the rolled sheet P is a label sheet. At S400, when the forced discharge control is started, at S401, the cutter operation control part 80 makes the cutter 53 cut the label sheet (more specifically a middle section between the labels) in front of the next writing position (that is, the middle section means a space between the labels).

At S402, the print operation up to the cut position is executed and the printed label sheet is ejected outside the image forming apparatus so that it becomes a state in which the label sheets do not remain at least at the secondary transfer position.

At S403, the control part 60 suspends the operation of the printing process (print step operation). The operations executed at S403 are, for example, stopping of the drive of the rolled sheet feeder 51 by the carrying motor control part 78, the stopping of the drive of the intermediate transfer belt 31, the secondary transfer roller 54, and the photosensitive drum 11 by the drive motor control part 79, the stopping of the drive of the optical head 13 by the head drive control part 75, etc.

At S404, the secondary transfer roller 54 is separated from the intermediate transfer belt 31 by the separating operation control part 81.

At S405, the control part 60 makes the parts including the process execution parts 10 execute the forced discharge control based on the discharge dot count I*. The discharge amount of the toner is calculated by multiplying the standard dot count value (discharge dot count I*) by the amount of toner supplied to the photosensitive drum 11 from the development part 14 by the light emission (dot light emission) of one light emitting element 13*a* in a plurality of light emitting elements 13*a* in the optical head 13. That is, the control part 60 (for example, the print control part 61) makes the optical head 13 execute the dot light emission based on the discharge dot count I*, and an amount of toner to be discharged is discharged from the development part 14.

At S405, since all toner to be discharged by the forced discharge control is discharged, at S406, the discharge dot count I* is reset to 0 [count].

At S407, to execute the continuation of the print process based on the suspended print job, the secondary transfer roller 54 is brought into contact with the intermediate transfer belt 31 by the separating operation control part 81.

At S408 and S409, the drum count E* and the light emission dot count F* are reset to 0 [count].

At S410, the print process based on the suspended print job is restarted. The operations executed at S410 are, for example, restarting the drive of the rolled sheet feeder 51 by the carrying motor control part 78, restarting the drive of the intermediate transfer belt 31, the secondary transfer roller 54, and the photosensitive drum 11 by the drive motor control part 79, restarting the drive of the optical heads 13 by the head drive control part 75, etc. With the aforementioned steps, the forced discharge control is completed (Step S411).

In Embodiment 2, an example in which the label sheet is cut when carrying out the forced discharge control is shown, but the force discharge control can be executed without executing Step S401 and Step S402 (that is, the label sheet is not cut), and for example, in a state in which the label sheet remains in the fusing position and the secondary transfer positions, at S403, the heat application roller 55*a* and the pressure application roller 55*b* can be separated from the label sheet by the drive system, and at S404, the secondary transfer roller 54 and the intermediate transfer belt 31 can be separated from the label sheet. In that case, for example, at S410, the heat application roller 55*a* and the pressure application roller 55*b* are brought into contact with the label sheet.

<<2-3>> Effects

As described above, according to Embodiment 2, even while executing a print process based on one print job, when the discharge dot count I* reaches a predetermined threshold, the print process is suspended and a forced discharge process is executed, so the deteriorated toner can be discharged from the development part 14 before the quality of the print image decreases. Therefore, even in a case in which a print process based on one print job continues for a long time, the forced discharge process is executed at an appropriate timing and the print process is restarted after the deteriorated toner is discharged, the quality of the print image can be improved.

<<3>> Modified Example

In the aforementioned Embodiment, a color printer of a tandem system using a nonmagnetic one-component toner was described, but the present invention can be applied to an image forming apparatus using an electrographic system such as a direct transfer system printer or a printer using a two-component toner.

In Embodiments 1 and 2, examples in which the discharging location of the toner is the waste toner collection part 24 in the intermediate transfer belt 31 were described, but the toner (deteriorated toner) on the photosensitive drum 11 can be scraped off without transferring the toner (deteriorated toner) on the intermediate transfer belt 31 at the primary transfer part to accommodate the waste toner (deteriorated toner) in the waste toner accommodation part 140*b*.

What is claimed is:

1. An image forming apparatus for forming an image on a continuous medium by a print process based on a print job, comprising:

a process execution part that executes the print process;

a control part that controls an operation of the process execution part based on the print job; and a measuring part, wherein the process execution part includes an image carrier on which an electrostatic latent image is formed, an exposure part that is composed with a plurality of light emitting elements, the exposure part forming the electrostatic latent image on the image carrier by emitting light on the image carrier while light emission of each of the light emitting elements is controlled by the control part, and a development part that accommodates a developer and forms a developer image on the image carrier by supplying the developer to the image carrier, the measuring part measures an exposure dot number of each of the light emitting elements and a print amount executed by the print process, the control part makes the process execution part execute a discharge process to discharge the developer accommodated in the development part to an outside of the development part after completion of a print process based on a most recent print job and before intiation of a print process based on a next print job after the most recent print job, in the discharge process, the control part makes the exposure part execute light emission based on a discharge dot count value obtained using a measurement result measured by the measuring part during the print process based on the most recent print job, the measuring part measures a print amount executed during the print process for the print job, and the control part calculates the discharge dot count value (I) using a formula below;

$$I = R - F$$

F is a total value of exposure dot numbers of the light emitting elements measured during the print process based on a most recent print job, R is a value calculated by multiplying the print amount measured during the print process based on the most recent print job by a predetermined conversion factor.

2. The image forming apparatus according to claim 1, wherein a discharge amount of the developer that is discharged through the discharge process is calculated by multiplying the discharge dot count value by an amount of the developer supplied to the image carrier by light emission of one of the light emitting elements.

3. The image forming apparatus according to claim 1, wherein the print amount is a length of the continuous medium in a carrying direction on which a printing was performed by the print process based on the most recent print job.

4. The image forming apparatus according to claim 1, wherein the print amount is a number of rotations of the image carrier in the print process based on the most recent print job.

5. The image forming apparatus according to claim 1, wherein each of the light emitting elements is a light emitting diode.

6. The image forming apparatus according to claim 1, wherein the continuous medium is a rolled sheet, and the image forming apparatus includes a rolled sheet supply part for supplying the rolled sheet, and a rolled sheet winding part for winding up the rolled sheet supplied by the rolled sheet supply part.

7. An image forming apparatus for forming an image on a continuous medium by a print process based on a print job, comprising:

a process execution part that executes the print process;

a control part that controls an operation of the process execution part based on the print job; and a measuring part, wherein the process execution part includes an image carrier on which an electrostatic latent image is formed, an exposure part that is composed with a plurality of light emitting elements, the exposure part forming the electrostatic latent image on the image carrier by emitting light on the image carrier while light emission of each of the light emitting elements is controlled by the control part, and a development part that accommodates a developer and forms a developer image on the image carrier by supplying the developer to the image carrier, the measuring part measures an exposure dot number of each of the light emitting elements and a print amount executed by the print process, the control part makes the process execution part a discharge process to discharge the developer accommodated in the development part to an outside of the development part after completion of a print process based on a most recent print job and before intiation of a print process based on a next print job after the most recent print job, in the discharge process, the control part makes the exposure part execute light emission based on a discharge dot count value obtained using a measurement result measured by the measuring part during the print process based on the most recent print job, and when the discharge dot count value reaches a predetermined value before the completion of the print process based on the most recent print job, the control part makes the process execution part execute a forced discharge process for discharging the developer that is to be forcibly discharged at a beginning of the discharge process from the development part to an outside of the development part.

8. The image forming apparatus according to claim 7, wherein a discharge amount of the developer that is discharged through the discharge process is calculated by multiplying the discharge dot count value by an amount of the developer supplied to the image carrier by light emission of one of the light emitting elements.

9. The image forming apparatus according to claim 7, wherein the print amount is a length of the continuous medium in a carrying direction on which a printing was performed by the print process based on the most recent print job.

10. The image forming apparatus according to claim 7, wherein the print amount is a number of rotations of the image carrier in the print process based on the most recent print job.

11. The image forming apparatus according to claim 7, wherein each of the light emitting elements is a light emitting diode.

12. The image forming apparatus according to claim 7, wherein the continuous medium is a rolled sheet, and the image forming apparatus includes a rolled sheet supply part for supplying the rolled sheet, and a rolled sheet winding part for winding up the rolled sheet supplied by the rolled sheet supply part.

13. An image forming apparatus for forming an image on a continuous medium by a print process based on a print job, comprising:

a process execution part that executes the print process;

a control part that controls an operation of the process execution part based on the print job; and a measuring part, wherein the process execution part includes an image carrier on which an electrostatic latent image is formed, an exposure part that is composed with a plurality of light emitting elements, the exposure part forming the electrostatic latent image on the image carrier by emitting light on the image carrier while light emission of each of the light emitting elements is controlled by the control part, and a development part that accommodates a developer and forms a developer image on the image carrier by supplying the developer to the image carrier, the measuring part measures an exposure dot number of each of the light emitting elements and a print amount executed by the print process, the control part makes the process execution part a discharge process to discharge the developer accommodated in the development part to an outside of the development part after completion of a print process based on a most recent print job and before intiation of a print process based on a next print job after the most recent print job, in the discharge process, the control part makes the exposure part execute light emission based on a discharge dot count value obtained using a measurement result measured by the measuring part during the print process based on the most recent print job, and when the discharge dot count value is determined to be equal or larger than a predetermined standard dot count value, the control part makes the exposure part execute light emission based on the standard dot count value in the discharge process.

14. The image forming apparatus according to claim 13, wherein a discharge amount of the developer that is discharged through the discharge process is calculated by multiplying the discharge dot count value by an amount of the developer supplied to the image carrier by light emission of one of the light emitting elements.

15. The image forming apparatus according to claim 13, wherein the print amount is a length of the continuous medium in a carrying direction on which a printing was performed by the print process based on the most recent print job.

16. The image forming apparatus according to claim 13, wherein the print amount is a number of rotations of the image carrier in the print process based on the most recent print job.

17. The image forming apparatus according to claim 13, wherein each of the light emitting elements is a light emitting diode.

18. The image forming apparatus according to claim 13, wherein the continuous medium is a rolled sheet, and the image forming apparatus includes a rolled sheet supply part for supplying the rolled sheet, and a rolled sheet winding part for winding up the rolled sheet supplied by the rolled sheet supply part.

* * * * *